US007016630B2

(12) United States Patent
Yoshizaki et al.

(10) Patent No.: US 7,016,630 B2
(45) Date of Patent: Mar. 21, 2006

(54) IMAGE FORMING APPARATUS

(75) Inventors: Kazumi Yoshizaki, Ibaraki (JP); Kenji Okado, Ibaraki (JP); Masashige Tamura, Chiba (JP); Naotaka Ikeda, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 79 days.

(21) Appl. No.: 10/836,278

(22) Filed: May 3, 2004

(65) Prior Publication Data

US 2004/0258434 A1 Dec. 23, 2004

(30) Foreign Application Priority Data

May 2, 2003 (JP) ..... 2003-126896

(51) Int. Cl.
*G03G 15/08* (2006.01)

(52) U.S. Cl. ..... 399/258; 399/104

(58) Field of Classification Search ..... 399/104, 399/258, 259, 260, 262, 263
See application file for complete search history.

(56) References Cited

U.S. PATENT DOCUMENTS 5,450,169 A * 9/1995 Hart et al. ..... 399/104
6,597,881 B1 * 7/2003 Hatori et al. ..... 399/227

FOREIGN PATENT DOCUMENTS

| | | |
|---|---|---|
| JP | 5-224530 | 9/1993 |
| JP | 6-83196 | 3/1994 |
| JP | 6-161246 | 6/1994 |
| JP | 2001-134053 | 5/2001 |

OTHER PUBLICATIONS

Brandrup, et al, "Polymer Handbook" Second Edition.

* cited by examiner

*Primary Examiner*—Hoang Ngo
(74) *Attorney, Agent, or Firm*—Fitzpatrick, Cella, Harper & Scinto

(57) ABSTRACT

In an image forming apparatus having a powder transport mechanism including a powder container and a powder transport means which rotates relative to the powder container, the powder transport means has the rotation center substantially on the axis of the powder container, and the space between the inner wall surface of the powder container and the powder transport means is sealed with magnetic particles held by a magnetic-filed generation means. The magnetic particles have a specific saturation magnetization σs and a specific value of $A \times \sigma_A$ where the residual magnetic flux density of the magnetic-field generation means is represented by A in a specific range and the magnetization intencity of the magnetic particles in a magnetic field with the residual magnetic flux density A is represented by $\sigma_A$.

11 Claims, 6 Drawing Sheets

IMAGE FORMING APPARATUS

BACKGROUND OF THE INVENTION

1. Field of the Invention

This invention relates to an image forming apparatus used in recording processes utilizing electrophotography, electrostatic recording and so forth. More particularly, it relates to an image forming apparatus which has a powder transport mechanism intended to replenish a toner (or a mixture of a toner and a carrier) to a developing assembly, and transports the powder especially in a high precision to enable stable and high-quality image formation.

2. Related Background Art

In recent years, machinery making use of electrophotography is applied in apparatus such as facsimile machine and printers in addition to conventional copying machines. As coming to be applied in a broader range, the machinery has come to be strongly desired to achieve high-speed, long-lifetime, high-stability and full-color image formation while having compactness, low cost and high image quality.

In particular, as a need for full-color electrophotography, the number of reproduction has increased because of reproduction of maps, design pictures, photographs and so forth, and it is called for them to have good color reproduction and be very minutely and faithfully reproduced without crushed images or broken-off images over details.

In most developing assemblies of full-color image forming apparatus, two-component developers are used from the viewpoint of color development and color mixing performance. As well known, in order to achieve stable developing performance, it is an important factor that the mixing ratio of toner to carrier (hereinafter "T/C ratio") of a two-component developer is kept at a certain value. The toner of a developer is consumed at the time of development, and the T/C ratio of the developer changes. Hence, it is necessary to opportunely detect the T/C ratio of the developer in a developing assembly by means of a toner concentration control unit (ATR) so that the toner can be fed in accordance with its changes to always constantly control the mixing ratio in the developer to keep the quality level of images.

Now, it is very often seen to be so structured that the toner to be fed to the developing assembly is replenished from a toner cartridge through a transport section which is a powder transport mechanism. Also, in the powder transport mechanism, it has been common to use such a structure that the transport quantity is controlled using a transport screw which is a spiral auger. This is largely because of such advantages that the assembly can be made simple in structure and the transport quantity in one rotation of screw can be defined with ease to enable achievement of necessary controlled quantity in inexpensive structure (disclosed in, e.g., Japanese Patent Application Laid-open No. 2001-134053, No. H06-161246 and No. H06-083196).

However, at the present time that it is desired to reproduce at a high speed and stably images having various image percentages, ranging from images having a large image area as in photographs up to images having a small image area as in one-point colors, the toner has come active in its movement at the part of a clearance present between a toner transport pipe which forms an outer wall of the toner transport screw and the outer diameter of the toner transport screw. This has caused a flashing phenomenon that the toner slips through the clearance like water and therefore the toner is unwantedly fed in excess to the developing assembly.

In particular, in a full-color image forming apparatus having what is called a rotary unit, which is preferably used as an inexpensive and compact full-color image forming apparatus, a flashing phenomenon accompanying the rotation and stop impact of the rotary unit has occurred in some cases.

As a means for preventing such a flashing phenomenon, as disclosed in Japanese Patent Application Laid-open No. H05-224530, a method is proposed in which the clearance between the toner transport screw and the toner transport pipe is controlled.

However, at the present time that a desire for low-temperature fixing of toner is put forward from the viewpoint of energy saving, masses of toner may be formed to cause defective images, because, if the clearance is in a certain value or less, the clearance between the toner transport screw and the toner transport pipe comes to be lost because of mechanical characteristics such as eccentricity or run-out of the transport screw, so that the toner is rubbed between the toner transport screw and the toner transport pipe.

Even if the flashing phenomenon can be somehow prevented by spending production costs, e.g., by controlling the run-out or making higher the precision of inner diameter of the toner transport pipe, it has been still insufficient for achieving replenishment stability and precision which are high enough to continue to maintain a good stability for high image quality.

In particular, with an increase in toner consumption per unit time that is brought by making process speed higher, the toner transport screw is being made to be rotated at a higher speed. Under such circumstances, any image forming apparatus has not yet been found which has a toner transport mechanism having a simple structure, exhibiting always stable toner transport performance and promising superior stability for high image quality.

SUMMARY OF THE INVENTION

The present invention is to solve the problems the above background art has had. That is, an object of the present invention is to materialize in simple structure, and provide, an image forming apparatus making use of a powder (toner) transport mechanism having a superior stability for maintaining high image quality while enjoying low mass production cost and at the same time having high productivity, in which mechanism it is unnecessary to make small the clearance between the toner transport pipe and the toner transport screw.

Another object of the present invention is to provide an image forming apparatus that enables stable replenishment of toner in every environment and can always attain a proper toner concentration.

Still another object of the present invention is to provide an image forming apparatus that enables stable replenishment of toner in every environment and can obtain good images free of fog and spots around line images over a long period of time.

A further object of the present invention is to provide an image forming apparatus that can obtain over a long period of time good images which are free of image defects such as white lines, dots and so forth caused by toner melt adhesion or toner agglomerates.

A still further object of the present invention is to provide an image forming apparatus that can obtain stable images even in high-speed image formation.

A still further object of the present invention is to provide an image forming apparatus that can attain a stable image density whatever image percentage they have.

A still further object of the present invention is to provide an image forming apparatus that can obtain stable images even in a full-color image forming apparatus having what is called a rotary unit.

To achieve the above objects, the present invention provides an image forming apparatus comprising a powder transport mechanism having at least a powder container and a powder transport means which is rotatable relative to the powder container;

the powder transport means having a rotation center substantially on the axis of the powder container; and a space between the inner wall surface of the powder container and the powder transport means being sealed with magnetic particles held by a magnetic-filed generation means;

the magnetic particles having a saturation magnetization Us of from 30.0 to 80.0 $Am^2/kg$, and, where the residual magnetic flux density of the magnetic-filed generation means is represented by A mT and the intensity of magnetization of the magnetic particles in a magnetic field with the residual magnetic flux density A mT is represented by $\sigma_A$ $Am^2/kg$, having a value of $A\times\sigma_A$ of from 3,000 to 35,000, provided that A is within a range of from 50 to 1,000 mT.

DESCRIPTION OF THE PREFERRED EMBODIMENTS

Figure 1:
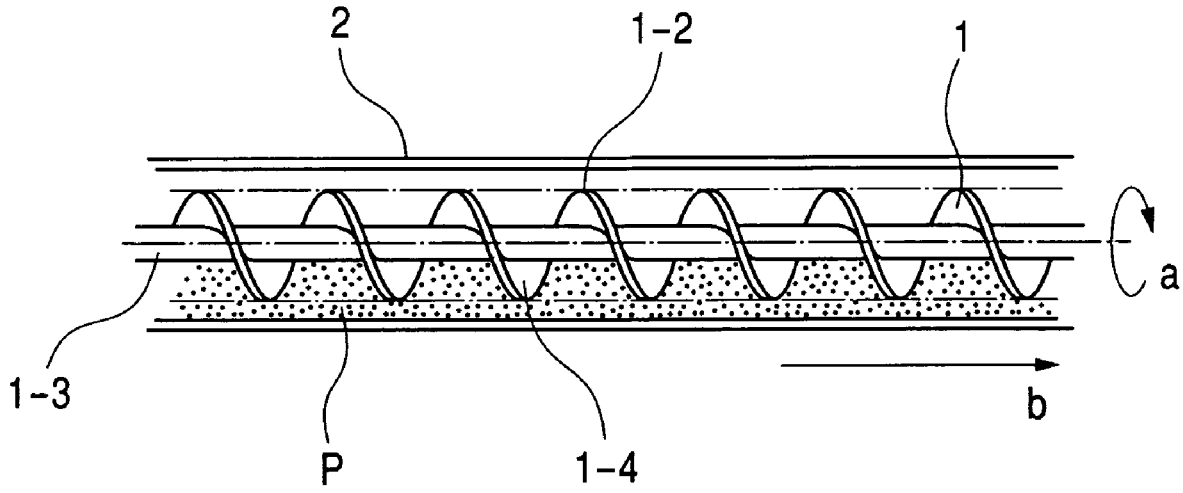
FIG. 1 is a main-part sectional structural view to describe a powder transport mechanism in Powder Transport Mechanism Example 1.

The present invention is described below in detail by giving embodiments of the present invention.

The image forming apparatus of the present invention has a powder transport mechanism having at least a powder container and a powder transport means which is rotatable relative to the powder container. The powder transport means has the center of rotation substantially oh the axis of the powder container, and the space between the inner wall surface of the powder container and the powder transport means is sealed with magnetic particles held by a magnetic-filed generation means. In this image forming apparatus, it is remarkably characterized in that the magnetic particles have a saturation magnetization as of from 30.0 to 80.0 $Am^2/kg$, and, where the residual magnetic flux density of the magnetic-filed generation means is represented by A mT and the intensity of magnetization of the magnetic particles in a magnetic field with the residual magnetic flux density A mT is represented by $\sigma_A$ $Am^2/kg$, have a value of $A\times\sigma_A$ of from 3,000 to 35,000.

In the powder transport mechanism, a powder transport pipe which is the powder container covers a powder transport screw which is the powder transport means, to form an outer wall, and the part of a clearance present between the powder transport pipe and the powder transport screw can be filled up with magnetic particles such as carrier particles by the aid of a magnetic binding force of the magnetic-filed generation means such as a magnet. Hence, a powder such as a toner which is the powder to be transported can be transported without slipping through the clearance. As a result, even if a liquefaction phenomenon has been caused by an improvement in fluidity of the powder to be transported, the magnetic particles can prevent the flashing phenomenon that the toner slips through the clearance.

According to the present invention, the above flashing phenomenon can be prevented, and hence the T/C ratio inside the developing assembly by no means comes to change, and it can be kept from occurring not only that the T/C ratio runs away toward a high T/C ratio but also that the toner spouts out of a developer container (vigorous toner scatter).

It is also possible not only to restrain the flashing phenomenon but also to control in a very good precision the quantity of the toner fed to the developing assembly. Thus, it is also expectable that a high image quality stability attributable to an improvement in replenishment performance can be materialized at a high level.

It can further be kept from occurring that the transport screw locks because of melt adhesion of the toner or that toner masses are formed to make the image level lower, which may occur when the clearance between the transport pipe and the transport screw is made smaller or when the number of revolutions of the transport screw is made higher in order to make transport speed higher.

The image forming apparatus having the powder transport mechanism according to the present invention can be expected to be effective also when structured as described below.

A case has come to be often seen in which a draw-up system is provided which draws the toner gravity-upward to a toner-transporting transport section, i.e., from a storage section where a toner is temporarily held in a toner holder, a toner bottle, to the developing assembly with which toner images are formed by development on an image bearing member, a photosensitive drum. Where the structure of the present invention is used in such a draw-up transport system, the transport precision can be stable and the performance of maintaining high image quality can also vastly be improved without any lowering of transport efficiency while dealing with high productivity.

Such a draw-up transport section can be made to have no clearance between the toner transport pipe inner wall and the transport screw, and hence the toner can be forwarded also at this gap portion. In particular, even when the number of revolutions of the toner transport screw is made higher, the toner transport efficiency by no means lowers, a superior transport stability can be achieved, and transport precision is also improved, leading to stabilization of high image quality.

The present invention can be expected to be effective also when the multi-color image forming apparatus having a rotary unit as described in Related Background Art has inside the rotary unit a toner transport section having the powder transport mechanism.

As described hithertofore, the transport precision in the toner transport section is an important factor that necessarily determines the toner concentration in the interior of the developing assembly. According to the present invention, it is expected that the T/C ratio in the developing assembly of the image forming apparatus is fairly more stable than ever. That is, the toner transport section has been made to have no clearance between the toner transport pipe inner wall and the toner transport screw, with the result that the T/C ratio in the developing assembly can be stable and besides developed images can be prevented from being formed as low-density images or high-density images, because the toner transport quantity in the toner transport section comes neither smaller nor larger than the quantity controlled, even when the rotation and stop of the rotary unit has applied not a little impact.

In addition, as the image forming apparatus is being made compact, low-cost, high-image-quality and high-productivity, and especially when high productivity is pursued, it may come necessary in the multi-color image forming apparatus having a rotary unit to make the rotary unit rotate at a higher speed or enlarge the number of revolutions of the transport screw in the toner transport section. Even under such circumstances, it is possible according to the present invention to make micro-control of replenishment in a good precision.

Powder Transport Mechanism Examples 1 and 2 in the present invention are shown below. Needless to say, the structure is by no means limited to these Powder Transport Mechanism Examples 1 and 2 as long as it is similar structure readily analogizable out of the gist of the present invention.

Powder Transport Mechanism Example 1

Powder Transport Mechanism Example 1 in the present invention is shown in FIGS. 1 to 4.

FIG. 1 is a main-part sectional structural view showing the toner transport section, which is a characteristic structure in Powder Transport Mechanism Example 1. In FIG. 1, reference numeral 1 denotes a powder transport means transport screw that is especially characteristic of Powder Transport Mechanism Example 1. The transport screw 1 is constituted of a spiral auger 1-2 which is the chief component with which the powder is transported and a sheetlike elastic magnet 1-1 (see FIG. 2) wound around the former, and is rotatably held around a rotational axis 1-3 set substantially as the center of rotation.

As also shown in FIG. 1, the transport screw 1 is provided in the interior of the transport pipe 2 which forms a cylindrical portion of the powder container supporting the transport screw 1 rotatably. Hence, these are so made up that a transporting powder (powder to be transported) P in the interior of the transport pipe 2 is transported by means of the transport screw 1. To describe this with reference to FIG. 1, the transporting powder P is, as the transport screw 1 is rotated in the direction of an arrow a shown in the drawing, transported in the direction of an arrow b shown in the drawing, following a transport slant 1-4 of the spiral auger 1-2 provided in the transport screw 1.

Figure 2:
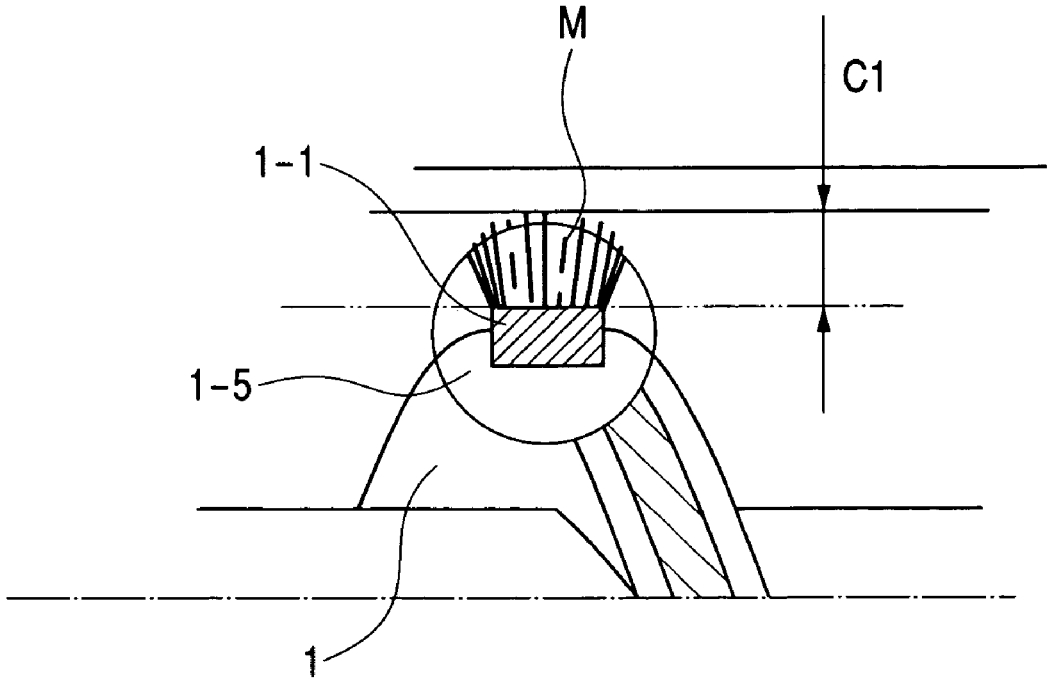
FIG. 2 is a main-part enlarged view to describe how a powder transport pipe and a powder transport screw are structured in Powder Transport Mechanism Example 1.

FIG. 2 is a main-part detailed view to describe how the sheetlike elastic magnet 1-1 of the transport screw 1 is stuck, which is most characteristic of Powder Transport Mechanism Example 1.

As shown in FIG. 2, in Powder Transport Mechanism Example 1, the transport screw 1 is formed of a resin molded member, and the spiral auger 1-2 has a recessed shape at its top portion 1-5 in order to secure the face to which the sheetlike elastic magnet 1-1 is to be stuck. Hence, when the sheetlike elastic magnet 1-1, made up in belt form, is stuck with an adhesive or the like, it can readily be stuck and also prevents the adhesive from flowing out to the transport slant 1-4 of the spiral auger 1-2. If the adhesive has actually flowed out, it may affect transport precision or may affect acceptance quality control as product units, and hence such flow out must be avoided.

The sheetlike elastic magnet 1-1 also stands exposed only partially, so that the magnetic lines of force may readily converge when a magnetic powder denoted by symbol M in FIG. 2 is attracted. That is, compared with structure in which the top portion 1-5 of the spiral auger 1-2 has a flat surface simply and the sheetlike elastic magnet 1-1 is stuck to the flat surface, there are advantages that the necessary magnetism of the sheetlike elastic magnet 1-1 can be kept low and that it is unnecessary to narrow clearance Cl between the inner wall of the transport pipe 2 and the top portion 1-5 of the spiral auger 1-2.

Figure 3:
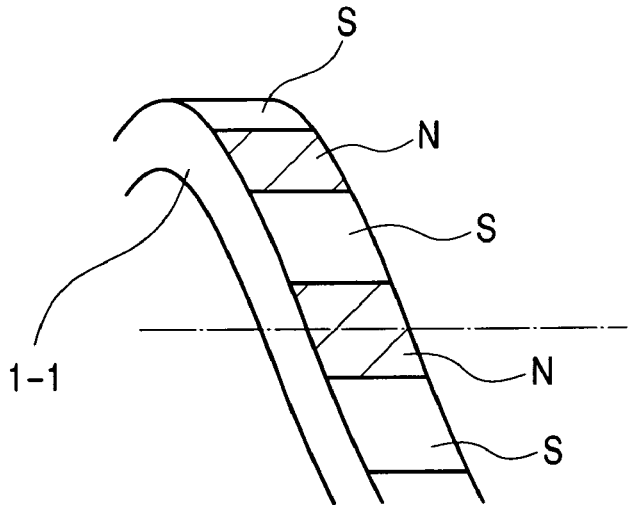
FIG. 3 is a main-part structure perspective view to describe how magnetic poles of a sheetlike elastic magnet are arranged in Powder Transport Mechanism Example 1.
Figure 4:
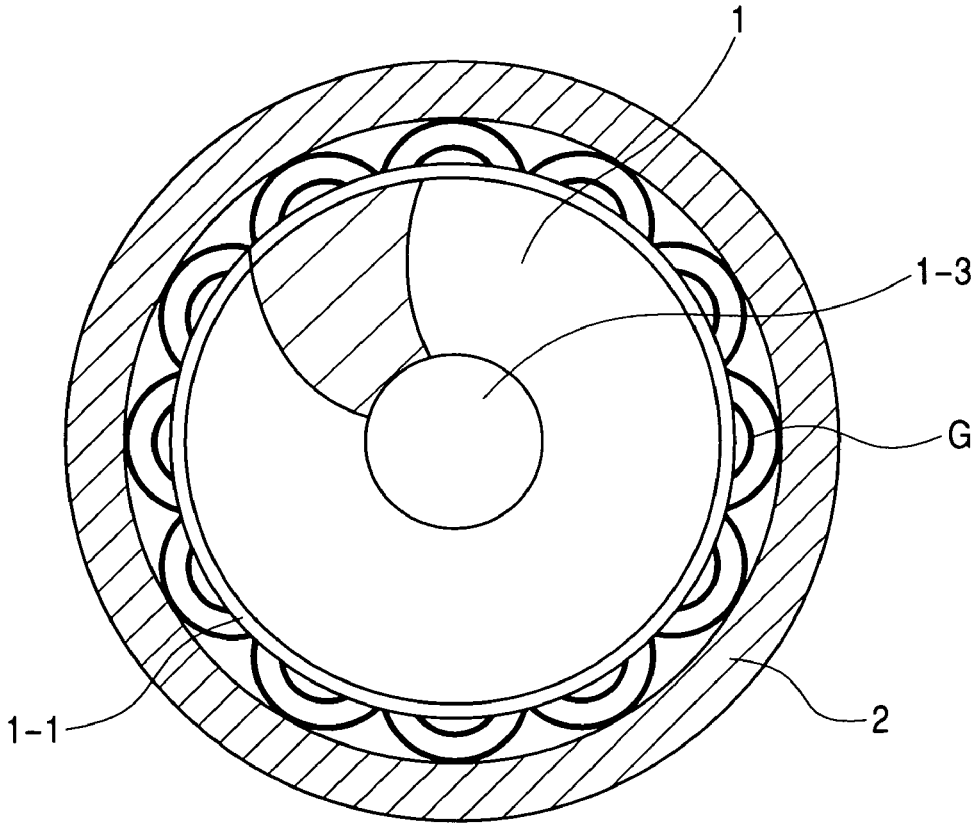
FIG. 4 is a sectional view to describe the state of magnetic lines of force of a powder transport screw in Powder Transport Mechanism Example 1.

FIG. 3 conceptionally illustrates how magnetic poles of the sheetlike elastic magnet 1-1 are arranged in Powder Transport Mechanism Example 1. FIG. 4 is a sectional structural view to describe the state of magnetic lines of force G in the case shown in FIG. 3. FIG. 4 presents a cross section formed when the powder transport mechanism is cut vertically to the axis of the screw. In Powder Transport Mechanism Example 1, the magnetic poles of the sheetlike elastic magnet 1-1 are so arranged as to be shown in FIG. 3.

This is because, taking account of mass productivity required when incorporated in actual products, a great raise in cost may result if magnetic-pole arrangement of N poles and S poles is provided in the width direction of the sheetlike elastic magnet 1-1 or magnetic-pole arrangement of N poles and S poles is provided on the surface and back thereof.

This is for the following reasons. First, if the magnetic-pole arrangement of N poles and S poles is provided in the width direction of the sheetlike elastic magnet 1-1, a very high cut precision is required, because a sheetlike elastic magnet material is originally so made up that the N poles and S poles are arranged alternately in stripes. Hence, when the N poles and S poles should be arranged in the lengthwise direction, a difference may be produced if the material is cut even slightly obliquely. Then, if the sheetlike elastic magnet 1-1 is wound on the spiral auger 1-2, the N pole at the beginning of winding changes to the S pole on the way of winding, which again turns to the N pole, so that the powder transport precision may greatly be affected. Thus, this must absolutely be avoided.

In addition, if the magnetic-pole arrangement of N poles and S poles is provided on the surface and back of the sheetlike elastic magnet 1-1 cut in a stripe, two-pole magnetism is required in a thin region, and hence it is difficult to secure the necessary magnetism.

When mass productivity is taken into account in this way, the present invention has succeeded in bringing surprising cost advantages.

In fact, in Powder Transport Mechanism Example 1, it has been ascertained that the effect brought by the sheetlike elastic magnet 1-1 stuck in to the recess provided at the top portion 1-5 of the spiral auger 1-2 as described above brings a sufficient effect also when such magnetic-pole arrangement is provided.

In fact, in the case of Powder Transport Mechanism Example 1, a good transport performance is obtainable when the residual magnetic flux density of the sheetlike elastic magnet 1-1 is set to be from 100 to 500 mT, and the clearance C1 from 0.5 to 1.5 mm. For example, the residual magnetic flux density of the sheetlike elastic magnet 1-1 may be set to be 240 mT, and the clearance C1 0.75 mm.

Thus, according to Powder Transport Mechanism Example 1, the magnetic material M is attracted to the sheetlike elastic magnet 1-1 provided at the recess of the top portion 1-5 of the spiral auger 1-2. Thus, the clearance C1 produced between the inner wall of the transport pipe 2 and the top portion 1-5 of the spiral auger 1-2 can be filled up. Hence, this makes it possible to transport the transporting powder P that has not been transportable under the influence of the slip-though of powder at the clearance C1, making it possible to enhance the transport efficiency of the spiral auger 1-2.

It is also unnecessary to narrow the clearance C1 to the utmost limit in an attempt to enhance transport precision and enhance transport efficiency. Hence, it is also unnecessary to strictly control the tolerance in producing the transport screw 1. This enables achievement of a high transport precision and a high transport efficiency while contributing to cost reduction.

Even where a further transport precision has come required, in Powder Transport Mechanism Example 1 the transport precision and the transport efficiency can originally be prevented from lowering under the influence of the slip-though of powder at the clearance C1. Hence, even when the clearance C1 is to be narrowed, a measure may only be taken in which the axis (shaft) 1-3 of the transport screw 1 is made up of a metal shaft, making it possible to achieve both the transport precision and the transport efficiency beyond comparison with any background art.

Also compared with the structure of mechanical seal having conventionally preferably been used, any powder masses may be formed insofar as any friction is produced, and it has been ascertained that the present invention is also effective in preventing the rotating drive system from having a high load and causing noise.

Powder Transport Mechanism Example 2

Figure 5:
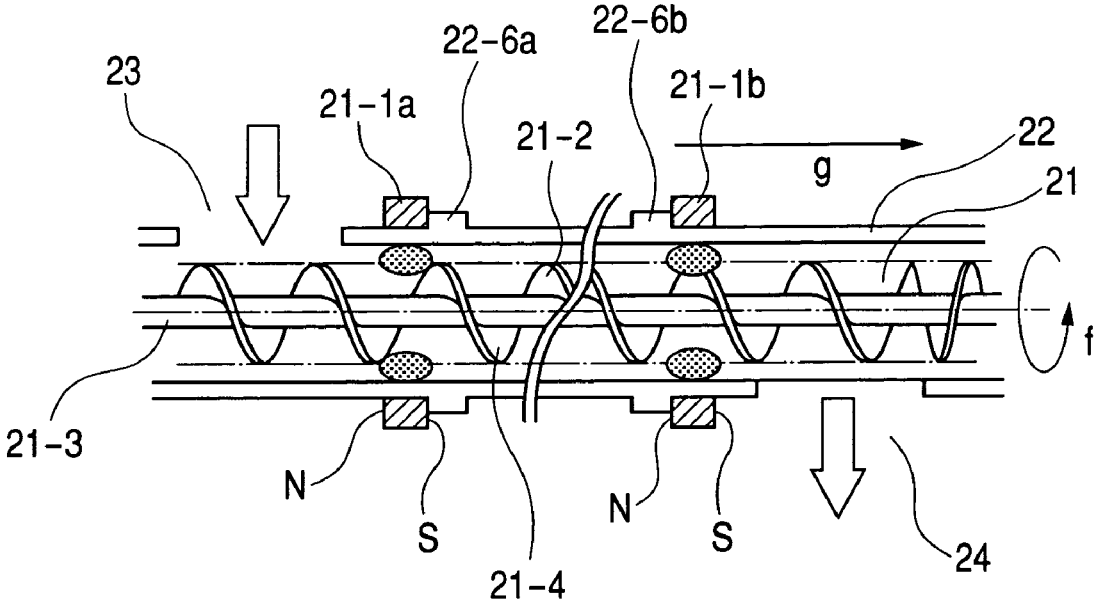
FIG. 5 is a main-part sectional structural view to describe a powder transport mechanism in Powder Transport Mechanism Example 2.
Figure 6:
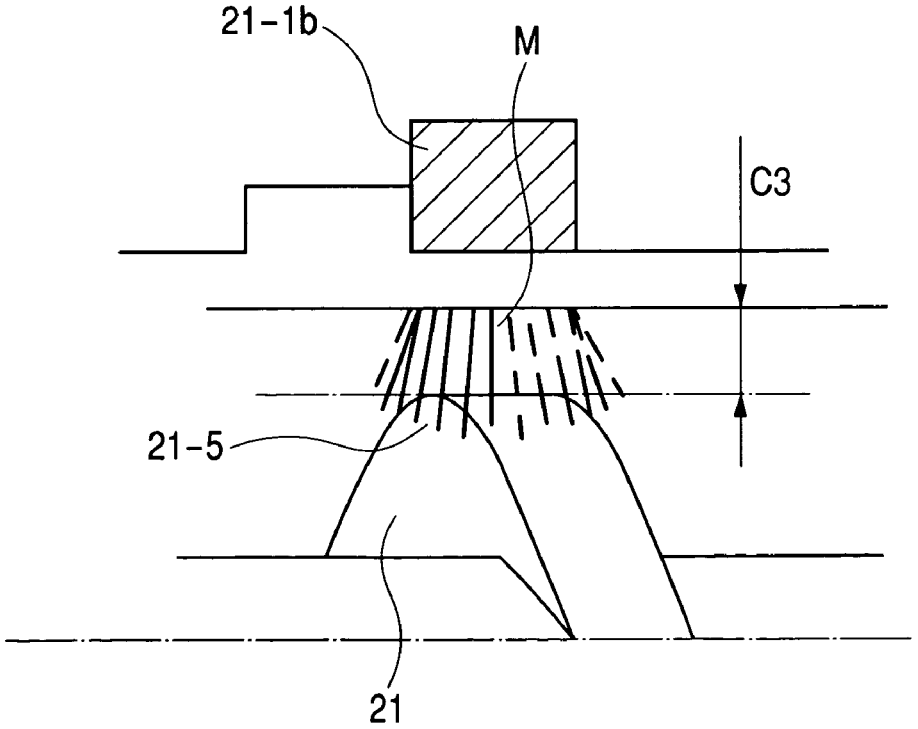
FIG. 6 is a main-part enlarged view to describe how a powder transport pipe and a powder transport screw are structured in Powder Transport Mechanism Example 2.

Powder Transport Mechanism Example 2 in the present invention is shown in FIGS. 5 and 6.

In Powder Transport Mechanism Example 2, description of portions different from those in Powder Transport Mechanism Example 1 is emphasized, and the overlapping portions are not described in some cases.

FIG. 5 is a main-part sectional structural view showing the toner transport section, which is a structure specific to Powder Transport Mechanism Example 2. In FIG. 5, reference numeral 21 denotes a transport screw which is a powder transport means in Powder Transport Mechanism Example 2. The transport screw 21 is constituted of a spiral auger 21-2 which is the chief component with which the powder is transported, and is rotatably held around a rotational axis 21-3 set substantially as the center of rotation. Then, reference numeral 22 denotes a transport pipe which forms a cylindrical portion of the powder container, and is especially characteristic of Powder Transport Mechanism Example 2. The transport pipe 22 is fixedly provided on its outer peripheral wall surface with a ringlike magnet members 21-1*a* and 21-1*b*. The ringlike magnet members 21-1*a* and 21-1*b* are, as shown in the drawing, set in from the outside of the transport pipe 22, inserted up to projections denoted by reference numerals 22-6*a* and 22-6*b*, and thereafter fixed with an adhesive.

In addition, in Powder Transport Mechanism Example 2, an example is shown in which two ringlike magnet members 21-1 (21-1*a* and 21-1*b*) are used. Needless to say, from the gist of the present invention, the number of the ringlike magnet members 21-1 is by no means limited to this.

Like Powder Transport Mechanism Example 1, as shown in FIG. 5, the transport screw 21 is provided in the interior of the transport pipe 22 which supports the transport screw 21 rotatably. Hence, these are so made up that a transporting powder (powder to be transported) P in the interior of the transport pipe 22 is transported by means of the transport screw 21. To describe this with reference to FIG. 5, the transporting powder P is, as the transport screw 21 is rotated in the direction of an arrow f shown in the drawing, transported in the direction of an arrow g shown in the drawing, following a transport slant 21-4 of the spiral auger 21-2 provided in the transport screw 21.

FIG. 6 is a main-part detailed view to describe how the ringlike magnet members 21-1 of the transport pipe 22 are magnetized, which are most characteristic of Powder Transport Mechanism Example 2.

As shown in these FIGS. 5 and 6, in Powder Transport Mechanism Example 2, it can be cited as a characteristic feature that the transport screw 21 is formed of a common transport screw and the ringlike magnet member 21-1 is fixedly provided on the outer periphery of the transport pipe 22. In addition, magnet poles of the ringlike magnet members 21-1 in Powder Transport Mechanism Example 2 are so arranged that, as shown in FIG. 5, one end face of the ring is the N pole, and the other face the S pole. In general, ringlike magnet members are somewhat more expensive than sheetlike elastic magnets, but magnetism may be set larger insofar as the former has no elastic properties. Hence, their effect can sufficiently be brought out in the interior although they are installed on the outer periphery of the transport pipe 22 as shown in Powder Transport Mechanism Example 2.

It has also been ascertained that, since they can exhibit a higher magnetism than the sheetlike elastic magnets, firm magnetic curtains can be formed by a magnetic material M on the inner wall of the transport pipe 22, making it possible to bring out a sufficient effect by providing magnetic seals at few portions as shown in Powder Transport Mechanism Example 2.

In Powder Transport Mechanism Example 2, where a replenishing opening through which the transporting powder P is fed is denoted by reference numeral 23, and a discharge opening by 24, the ringlike magnet members 21-1*a* and 21-1*b* are disposed at two parts in the vicinity of the replenishing opening 23 and the discharging opening 24 to materialize high transport precision and transport efficiency.

As an advantage of Powder Transport Mechanism Example 2, it may be noted that, since no sheetlike elastic magnet is stuck to the spiral auger 21-2 of the transport screw 21 at its top portion 21-5, the shape of the transport screw 21 may arbitrarily be set and also the inner periphery of the transport pipe 22 may be made up in the same way as that of an ordinary transport pipe, and hence these may be designed at a high degree of freedom.

In addition, as being different from the structure in which the sheetlike elastic magnet is stuck as shown in Powder Transport Mechanism Example 1, there is also no requirement for the precision of sticking, and it is unnecessary to severely set standards for squeeze-out or leak of the adhesive. Hence, this greatly contributes to cost reduction in assemblage steps. Moreover, a condition of the rise of ears of the magnetic material M may be set vertical to the transport direction g of the transporting powder P, and hence a higher transport effect can be obtained, consequently bringing such an additional effect that a high transport precision can also be achieved.

Thus, inasmuch as the direction of the rise of ears of the magnetic material M is set vertical to the transport direction g of the transporting powder P, it has also been ascertained that there is such an advantage that a clearance C3 produced between the inner periphery of the transport pipe 22 and the transport screw 21 may be set a little wider than that in the case of Powder Transport Mechanism Example 1.

More specifically, like Powder Transport Mechanism Example 1, there are advantages that it is unnecessary to narrow the clearance C3 to the utmost limit taking into account the influence of the slip-though of powder at the clearance C3 produced between the inner periphery of the transport pipe 22 and the transport screw 21, and that it is unnecessary to set the magnetism of the ringlike magnet member 21-1 higher than is necessary.

Thus, in Powder Transport Mechanism Example 2, taking assemblage performance into account, the present invention has succeeded in bringing great cost advantages and at the same time achieving high transport precision and transport efficiency.

In fact, in the case of Powder Transport Mechanism Example 2, a good transport performance is obtainable when the residual magnetic flux density of the ringlike magnet member 21-1 is set to be from 230 to 1,000 mT, and the clearance C3 from 0.5 to 2.0 mm. For example, the residual magnetic flux density of the ringlike magnet member 21-1 may be set to be 650 mT, and the clearance C3 1.0 mm.

Thus, according to Powder Transport Mechanism Example 2, the magnetic material M is attracted by the ringlike magnet members 21-1 provided fixedly on the outer periphery of the transport pipe 2, to the inner periphery of the transport pipe 2 at the part corresponding to the former. Thus, the clearance C3 produced between the inner wall of the transport pipe 22 and the spiral auger top portion 21-5 can be filled up. Hence, the same effect as that in Powder Transport Mechanism Example 1 can be obtained. That is, this makes it possible to transport the transporting powder P that has not been transportable under the influence of the slip-though of powder at the clearance C3, making it possible to enhance the transport efficiency of the spiral auger 21-2.

It is also unnecessary to narrow the clearance C3 to the utmost limit in an attempt to enhance transport precision and enhance transport efficiency. Hence, it is also unnecessary to strictly control the run-out of the transport screw 1. This enables achievement of a high transport precision and a high transport efficiency while contributing to cost reduction.

Even where a further transport precision has come required, alos in Powder Transport Mechanism Example 2, the transport precision and the transport efficiency can originally be prevented from lowering under the influence of the slip-though of powder at the clearance C3. Hence, even when the clearance C3 is to be narrowed, a measure may only be taken in which the axis (shaft) 21-3 of the transport screw 1 is made up of a metal shaft, making it possible to achieve both the transport precision and the transport efficiency beyond comparison with any background art.

Image Forming Apparatus Example 1 is described below which has the powder transport mechanism according to the present invention as a toner transport mechanism intended for the replenishment of toner to the developing assembly.

In addition, an example is given here in which the powder transport mechanism is used in a mechanism for transporting a replenishing toner to the developing assembly. Needless to say, entirely the same effect is obtained also when used in a powder transport section for a waste developer or the like.

In an image forming method in the image forming apparatus of the present invention, any methods may be used, such as a method in which visible color developed images formed on an electrostatic latent image bearing member are directly transferred to a transfer material, or an intermediate transfer method in which all color developed images are superimposingly transferred to an intermediate transfer member, and thereafter transferred to a transfer material en bloc.

Further, needless to say, the structure is by no means limited to this Image Forming Apparatus Example 1 as long as it is similar structure readily analogizable out of the gist of the present invention.

Image Forming Apparatus Example 1

Figure 7:
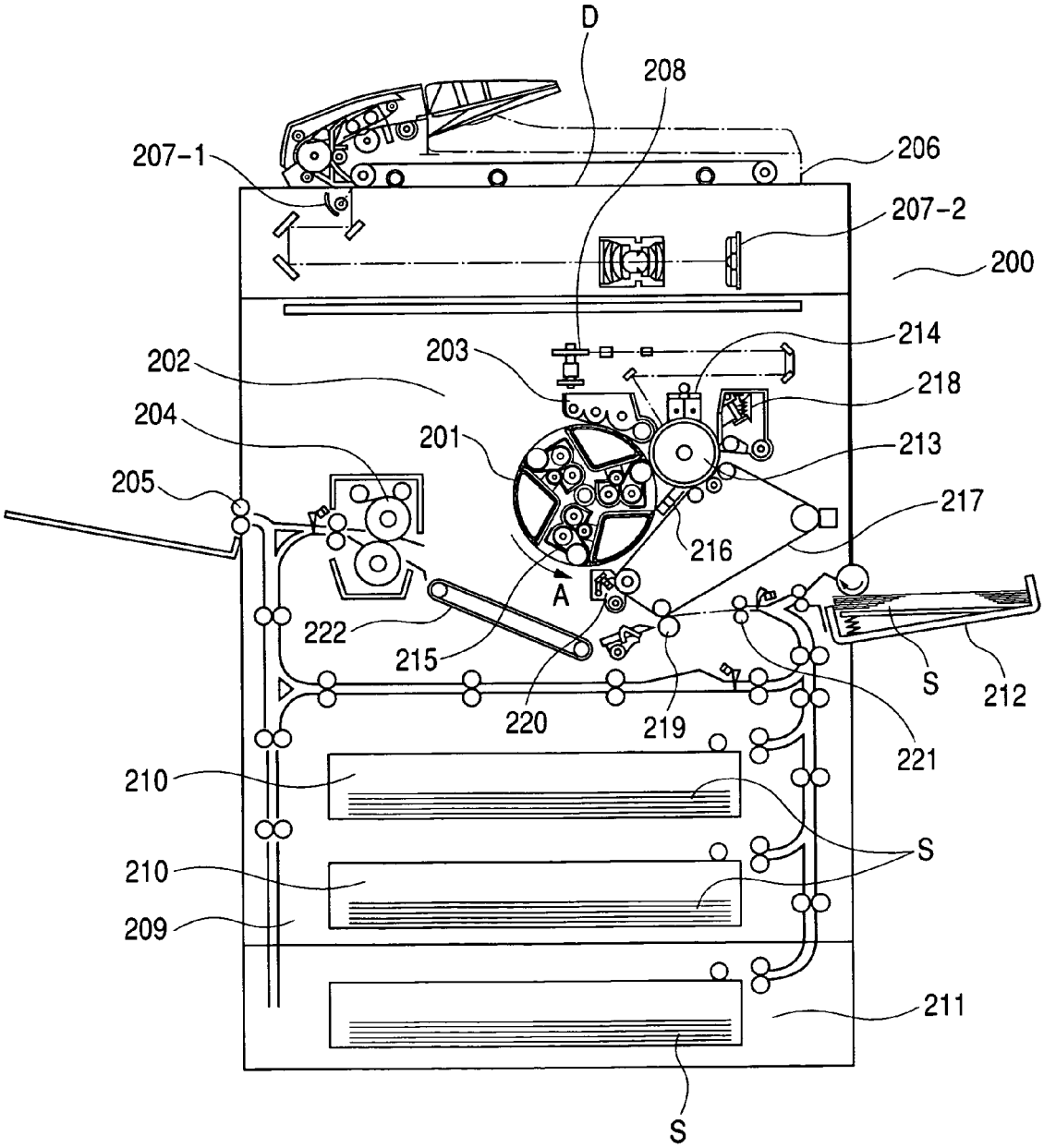
FIG. 7 is a main-part structure front view to describe a multi-color image forming apparatus in Image Forming Apparatus Example 1.

Image Forming Apparatus Example 1 having the powder transport mechanism according to the present invention is shown in FIG. 7.

FIG. 7 shows an example of a multi-color image forming apparatus (color copying machine) having a rotary developing unit which is a rotary body.

The constitution as shown in this drawing includes a rotary developing unit 201 having in its interior a powder transport section which is the powder transport mechanism, which is most characteristic of Image Forming Apparatus Example 1, and a multi-color image forming apparatus main body 200 having this rotary developing unit.

An apparatus main body 200 has an original put-on glass 206, light sources 207-1 and 207-2, a lens system 208, a paper feed section 209 and an image forming section 202. The paper feed section 209 has cassettes 210 and 211 holding therein transfer materials and detachable from the apparatus main body 200, and a manual feed cassette 212. Transfer materials are fed from these cassettes 210 and 211 and the manual feed cassette 212. The image forming section 202 is provided with a black developing assembly 203 set up alone, a cylindrical photosensitive drum 213, a primary charging assembly 214, a rotary developing unit 201 having therein other three-color color developing assemblies 215 set integrally with a toner cartridge, a post charging assembly 216 which controls image quality after development, an endless circulatory transfer belt 217 from which multi-color images are to be transferred to transfer materials after four-color toner images have superimposingly transferred thereto from the photosensitive drum 213, a drum cleaner 218 which removes residual toner on the photosensitive drum by cleaning, a secondary-transfer roller 219 which makes toner images transfer from the transfer belt to transfer materials, and a belt cleaner 220 which removes residual toner on the transfer belt by cleaning.

In addition, as shown in FIG. 7, in Image Forming Apparatus Example 1, the image forming section is provided with the black developing assembly 203 and the rotary developing unit 201, and the rotary developing unit 201 is so made up as to have three-color color developing assemblies, a yellow developing assembly 215Y, a magenta developing assembly 215M and a cyan developing assembly 215C. Needless to say, from the gist of the present invention, the number of developing assemblies mounted to the rotary developing unit 201 is by no means limited to this.

The image forming section is provided on its upstream side with a registration roller 221 which sends transfer materials in a good timing matching to toner images held on the transfer belt; and on its downstream side, a transfer transport assembly 222 which transports transfer materials S to which toner images have been transferred, a fixing assembly 204 which fixes unfixed toner images held on transfer materials S, and a delivery roller 205 which delivers out of the multiple-color image forming apparatus the transfer materials S on which toner images have been fixed.

It is described below how this multiple-color image forming apparatus operates.

Paper feed signals are outputted from a control unit (not shown) provided on the apparatus main body 200 side, whereupon a transfer material S is fed from the cassette 210 or 211 or the manual feed cassette 212. Meanwhile, the light applied from the light source 207-1 to, and reflecting from, an original D placed on the original put-on glass 206 is first read by a CCD unit 207-2. Thereafter, it is converted into electrical signals, which are inputted to a laser scanner unit 208, and are transformed into laser light which is emitted therefrom and to which the photosensitive drum 213 is exposed. The photosensitive drum 213 is beforehand electrostatically charged by the primary charging assembly 214. An electrostatic latent image is formed thereon upon exposure to the light, and is then developed by the black developing assembly 203, so that a black toner image is formed.

The toner image formed on the photosensitive drum 213 is potential-controlled by the post charging assembly 216, and is soon transferred to the transfer belt 217 at a transfer position. Where the toner image transferred is in a color mode, the transfer belt 217 is further rotated once so that the next toner image can be formed and transferred. During this operation, the rotary developing unit 201 is, in order to first prepare for the formation of a first toner image, rotated in the direction of an arrow A so that a developing assembly for a designated color faces the photosensitive drum 213, and prepares for the development of a next electrostatic latent image. Thus, in a full-color mode, the formation of an electrostatic latent image, the development thereof and the transfer are repeated until toner images in a stated number of images have been transferred.

Now, the transfer material S fed from the paper feed section 209 is corrected for skewing by the registration roller 221, and is synchronizingly sent to the image forming section 202. Then, the toner images are transferred thereto by the secondary transfer roller 219. The transfer material S separated is transported by the transport assembly 222 to the fixing assembly 204, and the unfixed transferred toner images are permanently fixed to the transfer material S by the action of heat and pressure of the fixing assembly 204. The transfer material S to which the images have been fixed is delivered out of the apparatus main body 200.

Thus, the transfer materials S fed from the paper feed section 209 are, after images have been formed thereon, delivered out of the apparatus main body.

In addition, where black-and-white images are formed, the toner image formed on the photosensitive drum 213 by the black developing assembly 203, which holds a black toner, is primarily transferred onto the transfer belt 217 and thereafter secondarily transferred at once to the transfer material S. The transfer material S separated from the transfer belt 217 is transported by the transport assembly 222 to the fixing assembly 204, and the toner image is pressed and heated by the fixing assembly 204 to become a permanent image. The monochromatic image formation by this system has a image productivity about four times higher than the full-color image formation.

Figure 8:
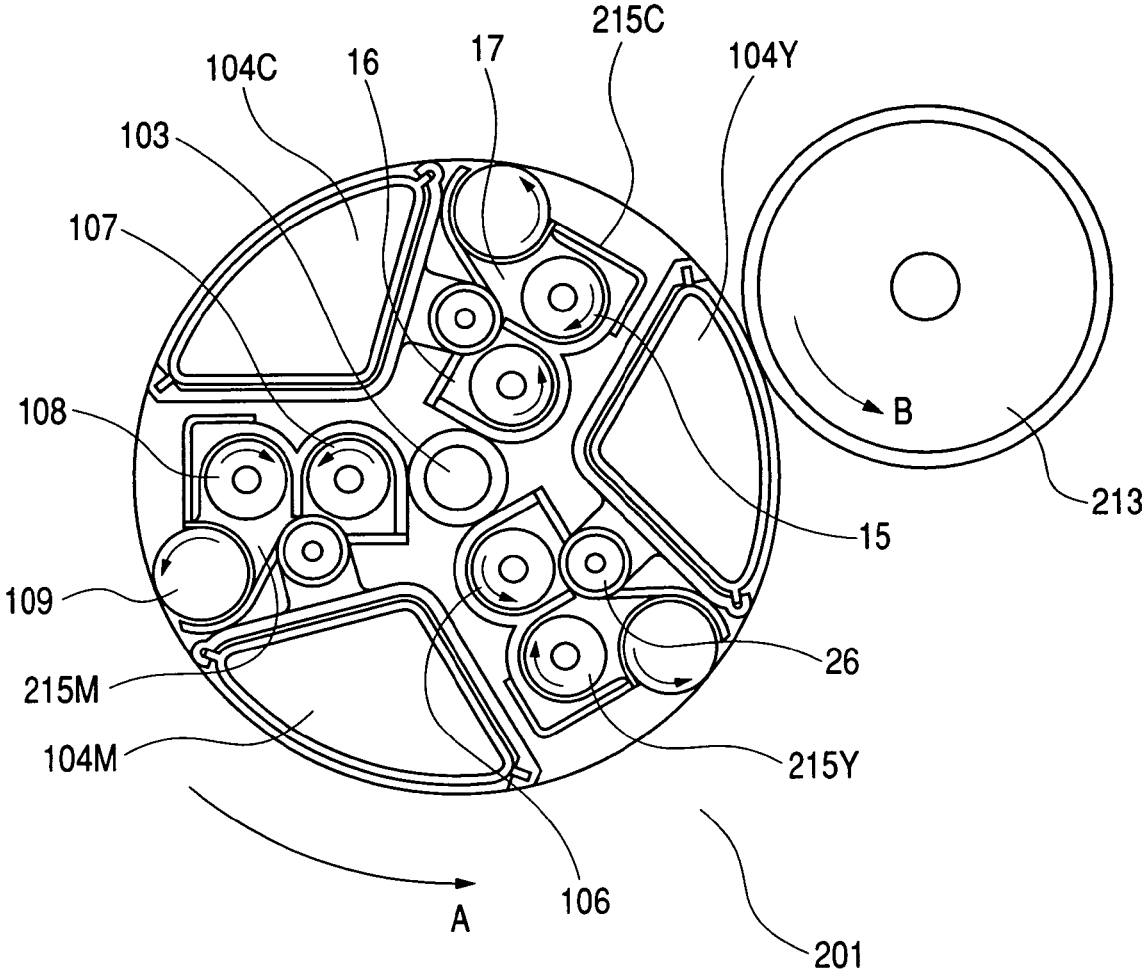
FIG. 8 is a main-part structure front view to describe a rotary unit in Image Forming Apparatus Example 1.

Structure of the rotary developing unit 201 is described below in detail with reference to FIG. 8, having a developer transport section 61 which is the powder transport mechanism that is the part characteristic of Image Forming Apparatus Example 1. In FIG. 8, reference numeral 62 denotes a toner bottle disposed inside the rotary developing unit 201; 215, the color developing assembly described previously, which in a fifth example of the present invention is constituted of three-color assemblies, the yellow developing assembly 215Y, the magenta developing assembly 215M and the cyan developing assembly 215C. In a case in which color is not specified, these are called the color developing assembly 215 as representation.

Figure 9:
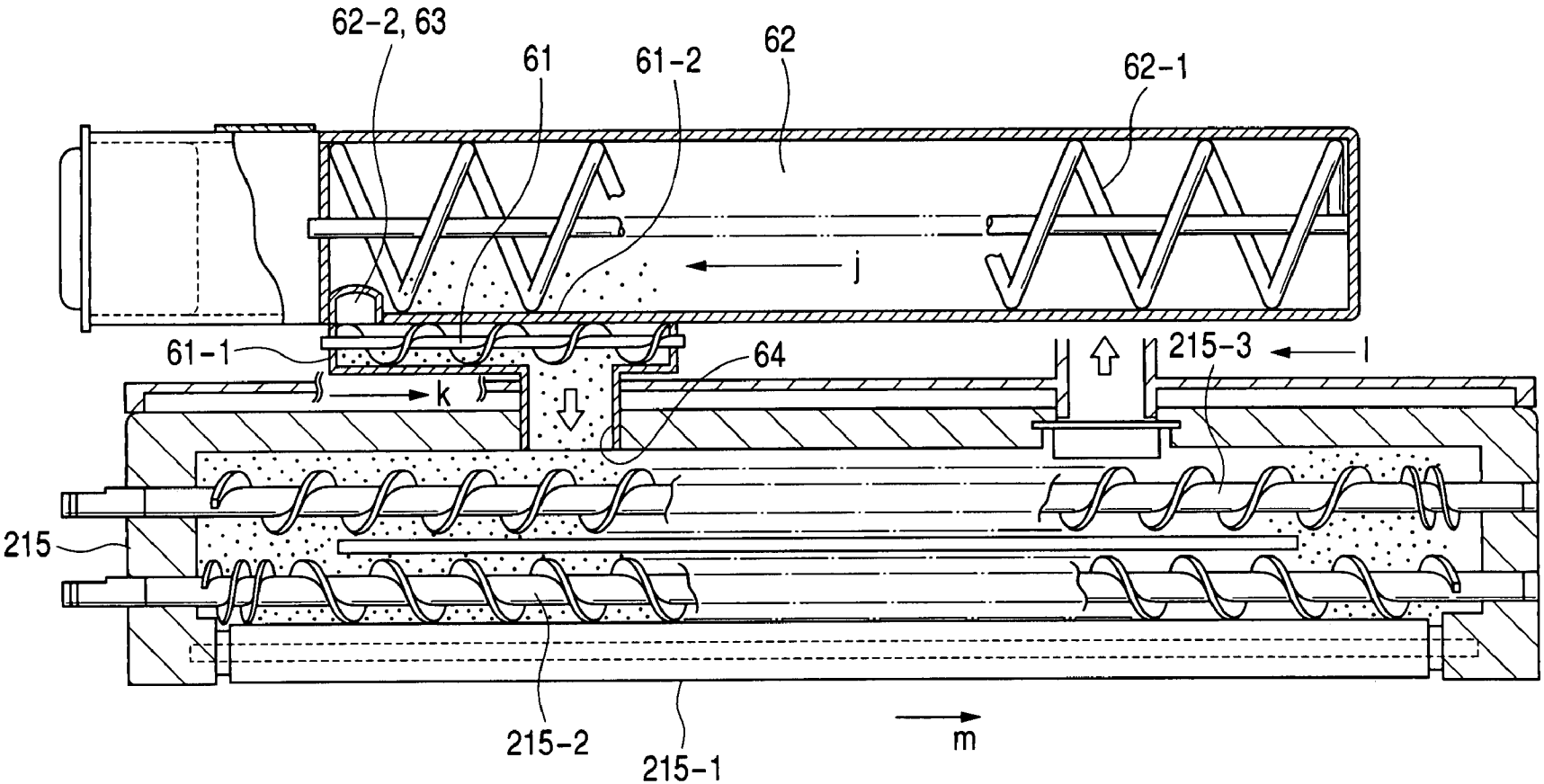
FIG. 9 is a main-part unfolded top view to describe transport structure of a powder transport mechanism in Image Forming Apparatus Example 1.

FIG. 9 is a main-part unfolded top view of the color developing assembly 215. As shown in this drawing, the developer transport section 61 is provided on one end thereof with a replenishing opening 63 through which the toner is taken from the toner bottle 62 and on the other end thereof with a feed opening 64 through which the toner is fed to the color developing assembly 215. Thus, developer transport section 61 is so disposed and made up that the replenishment quantity of the toner fed to the color developing assembly 215 is controlled by the rotational time (amount of rotation) of a replenishing screw 61-1 of the developer transport section 61.

In addition, as stated previously, the image forming apparatus available in recent years are made to be operated at higher-speed, and the rotary developing unit 201 is rotated at a very high speed to contribute to increase in productivity as multi-color image forming apparatus. However, as the rotary developing unit 201 is rotated at a higher speed for high-speed operation, the impact at the time of start and stop of the rotation comes larger. Meanwhile, the image forming apparatus available in recent years are being developed to produce higher-image-quality, and toners as developers have come to have smaller particle diameters more and more. Then, this may cause the liquefaction phenomenon such that the behavior of the toner in the interior of a transport pipe 61-2 comes substantially equal to that of water at the time of start and stop of the rotation of the rotary developing unit 201. As a result, although the replenishing screw 61-1 is not rotated, unexpected toner may be fed to the interior of the color developing assembly 215 under the influence of the slip-through of powder at the clearance between the inner wall of the transport pipe 61-2 and the periphery of the replenishing screw 61-1.

In Image Forming Apparatus Example 1, as structure of the powder transport mechanism used in the developer transport section 61 which is the powder transport mechanism, it includes the structure in which the sheetlike elastic magnet is cut in a stripe and stuck to the top portion of the spiral auger as shown in Transport Mechanism Example 1, and the structure in which the ringlike magnet member shown in Transport Mechanism Example 2 is provided in the vicinity of the replenishing opening 63 and in the vicinity of the feed opening 64, any of which is preferable.

Here, as an example, the case of using Transport Mechanism Example 1 will be described.

As described previously, as a result of having coped with the image quality sought to be made higher in recent years, toners used tend to have smaller particle diameter more and more. Further, the replenishment precision for the toner to be fed to the color developing assembly is also being required to be higher. Under such circumstances, where a higher productivity of multi-color image forming apparatus is further sought, it is necessary to rotate the rotary developing unit 201 at a higher speed so as to prepare for the start of development for each color. This is to keep the state of a toner coat on a developing sleeve 215-1 stable by rotating the developing sleeve 215-1 sufficiently and also to keep the state of agitation stable by rotating agitation transport screws 215-2 and 215-3 sufficiently, before the start of development.

However, in the case where the rotary developing unit 201 is rotated at a high speed in this way, the liquifaction phenomenon may occur as stated previously, so that unexpected toner may be fed to the interior of the color developing assembly 215 because of the slip-through of powder at the clearance between the inner wall of the transport pipe 61-2 and the periphery of the replenishing screw 61-1. If so, the required replenishment precision is not satisfied, and it is not achievable to make high image quality stable.

Under such circumstances in recent years that it is considered natural to achieve the high image quality, the above phenomenon has begun to affect the toner replenishment precision and the image stability greatly.

In order to avoid such circumstances, the use of the powder transport mechanism in the developer transport section 61 is very effective. In particular, the structure in which the sheetlike elastic magnet is cut in a stripe and stuck to the top portion of the spiral auger as shown in Transport Mechanism Example 1 is very favorable when used in the image forming apparatus in Image Forming Apparatus Example 1.

Thus, the transport efficiency of the spiral auger of the transport screw 61-1 is markedly improved. Further, also when the rotational replenishment is micro-controlled, the toner can be fed to the color developing assembly 215 substantially as aimed. Hence, the rotational speed of the rotary developing unit 201 can be set higher and the speed can also be made higher while achieving higher image quality.

In addition, for the purpose of operating image forming apparatus at much higher-speed, the time interval for which the rotary developing unit 201 can be stopped at the development position comes shorter, so that the time for which the toner can be fed to the color developing assembly 215 per one time is restricted. In such a case, the number of revolutions of the transport screw 61-1 tends to come large. However, stable toner feeding ability can be exhibited without lowering transport efficiency even if the number of revolutions of the transport screw 61-1 is made larger, and it is also possible to lead to higher image quality.

The magnetic particles used in the present invention are described below.

The magnetic particles used in the present invention have a saturation magnetization as of from 30.0 to 80.0 $Am^2/kg$. Also, it is an important characteristic feature that, where the residual magnetic flux density of a magnetic-filed generation means such as a magnet is represented by A mT and the intensity of magnetization of the magnetic particles in a magnetic field with the residual magnetic flux density A mT is represented by $\sigma_A$ $Am^2/kg$, the magnetic particles have a value of $A\times\sigma_A$ of from 3,000 to 35,000.

If the magnetic particles have a saturation magnetization as of less than 30.0 ($Am^2/kg$), even if the magnetic field obtained by the magnet is set as large as possible considering the balance with costs, the pressure of the transporting powder (powder to be transported) such as the toner having successively been sent by means of the transport screw may overcome the magnetic field which is binding the magnetic particles, and the magnetic particles bound there may be stripped off. As a result, this may make it impossible to obtain the effect of the present invention over a long period of time.

If the magnetic particles have a saturation magnetization $\sigma s$ of more than 80.0 ($Am^2/kg$), the magnetic seal (magnetic brush) obtained may be one having no flexibility unless the magnetic field formed by a magnet is set fairly small. As a result, the torque for rotating the transport screw may come large. This not only may apply a load to a motor but also may allow the transporting powder such as the toner to have a low transport performance because of obstruction by a hard magnetic brush. Moreover, it may also occur that the transporting powder such as the toner is caught between the transport pipe and the hard magnetic brush and rubbed there to form toner masses, lowering the level of images.

If the magnetic field of a magnet is set small, the magnetic field to be exerted inside the transport pipe may come non-uniform, tending to cause problems such as stripping of the magnetic particles.

In the magnetic particles used in the present invention, the range of proper intensity of magnetization $\sigma_A$ $Am^2/kg$ is also determined in accordance with the magnetic field obtained by the residual magnetic flux density A mT of the magnetic-field generation means such as a magnet.

More specifically, the value of $A\times\sigma_A$ must be within the range of from 3,000 to 35,000, and preferably from 3,500 to 30,000. This means that a relatively large intensity of magnetization of the magnetic particles must be selected when the magnet has a small residual magnetic flux density, and on the other hand a relatively small intensity of magnetization of the magnetic particles must be selected when the magnet has a large residual magnetic flux density.

If the value of $A\times\sigma_A$ is smaller than 3,000, the pressure of the transporting powder such as the toner having successively been sent by means of the transport screw may overcome the magnetic field which is binding the magnetic particles, and the magnetic particles bound there may be stripped off. As a result, this may make it impossible to obtain the effect of the present invention over a long period of time.

If the value of $A\times\sigma_A$ is larger than 35,000, the magnetic seal (magnetic brush) obtained may be one having no flexibility. As a result, the torque for rotating the transport screw may come large. This not only may apply a load to a motor but also may allow the transporting powder such as the toner to have a low transport performance because of obstruction by a hard magnetic brush. Moreover, it may also occur that the transporting powder such as the toner is caught between the transport pipe and the hard magnetic brush and rubbed there to form toner masses, lowering the level of images.

The magnetic properties of the magnetic particles may be measured with a vibration magnetic-field type magnetic-characteristic autographic recorder BHV-35, manufactured by Riken Denshi. Co., Ltd. As conditions for measurement when this instrument is used, an external magnetic field of $1{,}000/4\pi$ kA/m is formed. Meanwhile, a cylindrical plastic container is filled with the magnetic particles of the present invention in the state they have well densely been packed so that the magnetic particles do not move. In this state, the magnetic moment is measured, and the actual weight in the case where the sample is placed is measured to determine the intensity of magnetization $Am^2/kg$. When the $\sigma_A$ is measured, an external magnetic field equivalent to the magnetic field applied at the time of A mT may be formed to carry out measurement. For example, if the latter is 100 (mT), an external magnetic field of $1{,}000/4\pi$ (kA/m) may be applied.

The magnetic particles of the present invention may further preferably have a residual magnetization $\tau r$ of from 0.1 to 10.0 $Am^2/kg$, and more preferably from 0.1 to 7.0 $Am^2/kg$.

If the τr is smaller than 0.1 ($Am^2/kg$), the magnetic particles themselves may have a high fluidity even when the magnetic particles are present outside the magnetic field. This namely means that, if the magnetic particles that can not easily receive magnetic binding force of a magnet, such as particles at the top of the magnetic brush, have been stripped off the magnet, they come to be easily flowed through the clearance between the transport pipe and the transport screw together with the transporting powder such as the toner.

If the τr is larger than 10.0 ($Am^2/kg$), the magnetic particles may mutually come into chains even when the magnetic particles are present outside the magnetic field, resulting in a low fluidity of the magnetic particles. This namely means that, if the magnetic particles that can not easily receive magnetic binding force of a magnet, such as particles at the top of the magnetic brush, have been stripped off the magnet, they are liable to become agglomerates to inhibit proper transport of the transporting powder such as the toner.

The intensity of magnetization and the residual magnetization may be controlled by the type and amount of the magnetic material used and its use in combination with non-magnetic particles.

The magnetic particles used in the present invention may preferably have a volume-average particle diameter of from 25 μm to 60 μm, and more preferably from 30 μm to 50 μm.

If the magnetic particles have a volume-average particle diameter of less than 25 μm, the magnetic brush formed tend to be in a densely packed state, and can not satisfactorily transport the transporting powder such as the toner in some cases.

If the magnetic particles have a volume-average particle diameter of more than 60 μm, the denseness of the magnetic brush tends to be damaged, and can not easily perform powder transport in a high precision in some cases.

The volume-average particle diameter of the magnetic particles of the present invention refers to volume-based 50% average particle diameter measured with a laser diffraction particle size distribution meter (manufactured by Horiba Ltd.).

In addition, the volume-average particle diameter of the magnetic particles of the present invention may be controlled by conditions for producing the magnetic particles, by classification of the magnetic particles by means of a sieve or a classifier of various types, and by mixing of a classified product.

The magnetic particles used in the present invention may be made up of any materials without particular limitations as long as the above physical properties can be achieved. As examples preferably used, they may include toners containing magnetic particles, and magnetic carriers. Taking into account that they can sufficiently seal the clearance between the transport pipe and the transport screw and that they can avoid the risk of melt adhesion or the like which may lock the transport screw or form the toner masses to lower the level of images, a magnetic carrier having appropriate particle diameter and having individual particles with sufficient hardness may particularly preferably be used.

As methods for feeding the magnetic particles to the magnetic-filed generation means, available are a method in which the magnetic particles are kept adhered in a stated quantity to such a magnet as shown in Powder Transport Mechanism Examples 1 and 2, and a method preferably used in the case of the image forming apparatus having a rotary unit especially as in the case of Image Forming Apparatus Example 1. Besides, a method is available in which the magnetic particles are automatically fed by employing a method in which the developer having come back from the developing assembly during the rotation of the rotary unit are captured with a magnet to obtain the magnetic particles and a method in which development is performed while replenishing a replenishing two-component developer (hereinafter "carrier auto-refreshment developing system"). Any of these methods may be used alone. Instead, a plurality of methods may be used in combination so that the magnetic particles can more surely be kept bound to the magnetic-filed generation means, whereby stabler powder transport can be performed.

The magnetic carrier particularly preferably used in the present invention as the magnetic particles is described below.

A magnetic carrier core material preferably used in the present invention may include, e.g., magnetic particles selected from the group consisting of a magnetic metal such as surface-oxidized or unoxidized iron, nickel, copper, zinc, cobalt, manganese, chromium or a rare earth element, or a magnetic alloy or magnetic oxide thereof, and magnetic ferrite thereof; and magnetic-material-dispersed resin carriers obtained by dispersing magnetic powder in a resin.

The magnetic particles used in the present invention may be a magnetic-material-dispersed resin carrier constituted of a binder resin and metallic-compound particles dispersed therein containing a magnetic powder. This is preferable in order to effectively obtain the magnetic properties, particle diameter and so forth required in the present invention.

In particular, a magnetic-material-dispersed resin carrier obtained by polymerization not only can easily attain not only the magnetic properties, particle size distribution and so forth required for achieving the advantages of the present invention effectively, but also has highly spherical and uniform particles with uniform magnetic properties, and hence, enables highly precise and stable powder transport because it can readily make a stable magnetic brush highly dense at every spot.

The magnetic-material-dispersed resin carrier most preferably used in the present invention as the magnetic particles will be described below.

The magnetic-material-dispersed resin carrier may preferably contain metallic-compound particles in an amount of from 80 to 95% by weight in the carrier particles.

If the metallic-compound particles in the magnetic-material-dispersed resin carrier are in a content of less than 80% by weight, it may be difficult to obtain magnetic properties which are most suited to attain the constitution of the present invention. If on the other hand they are in a content of more than 95% by weight, the carrier particles may have a low strength to tend to cause a problem of, e.g., break of carrier particles, and hence stable powder transport can not be performed in some cases in a long-term image reproduction test.

The content of the metallic-compound particles is determined by measuring the weight (W1) of carrier particles at the initial stage and the weight (W2) of a residue having remaining after treatment with pH 1 or less strong acid for 24 hours or more, and according to the following expression:

$$[(W1-W2)/W1]\times 100.$$

As the binder resin in the magnetic-material-dispersed resin carrier, a thermosetting resin may preferably be used, and it may more preferably be a resin part or the whole of which has three-dimensionally been cross-linked. The use of this resin enables the dispersed metallic-compound particles to be firmly bound, and hence enables the magnetic-material-dispersed resin carrier to have a high strength, so that more stable toner transport can be performed over a long period of time.

As will be described later, the magnetic carrier used in the present invention may preferably be used after its particle surfaces have been coated with a coating resin and/or a coupling agent.

As a method for obtaining the magnetic-material-dispersed resin carrier, which is not particularly limited thereto, preferred is the use of a method of producing particles by a polymerization process in which, in a solution where a monomer constituting the binder resin and the metallic-compound particles have uniformly dispersed or dissolved in a solvent, the monomer is polymerized to form particles. In particular, a method is preferable in which the metallic-compound particles to be dispersed are subjected to lipophilic treatment so as to obtain a magnetic-material-dispersed resin carrier having a sharp particle size distribution and containing no fine powder.

As the monomer used to obtain the binder resin of the magnetic-material-dispersed resin carrier, a radical polymerizable monomer may be used. It may include, e.g., styrene; styrene derivatives such as o-methylstyrene, m-methylstyrene, p-methoxylstyrene, p-ethylstyrene and p-tert-butylstyrene; acrylic acid, and acrylates such as methyl acrylate, ethyl acrylate, n-butyl acrylate, n-propyl acrylate, isobutyl acrylate, octyl acrylate, dodecyl acrylate, 2-ethylhexyl acrylate, stearyl acrylate, 2-chloroethyl acrylate and phenyl acrylate; methacrylic acid, and methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminomethyl methacrylate, diethylaminomethyl methacrylate and benzyl methacrylate; 2-hydroxyethyl acrylate and 2-hydroxyethyl methacrylate; acrylonitrile, methacrylonitrile and acrylamide; vinyl ethers such as methyl vinyl ether, ethyl vinyl ether, propyl vinyl ether, n-butyl vinyl ether, isobutyl vinyl ether, β-chloroethyl vinyl ether, phenyl vinyl ether, p-methylphenyl vinyl ether, p-chlorophenyl vinyl ether, p-bromophenyl vinyl ether, p-nitrophenyl vinyl ether, and p-methoxyphenyl vinyl ether; and diene compounds such as butadiene.

Any of these monomers may be used alone or in the form of a mixture, and polymerization composition suitable for achieving preferable properties may be selected.

As described previously, the binder resin of the magnetic-material-dispersed resin carrier core particles may preferably be one having three-dimensionally been cross-linked, and a cross-linking agent capable of forming such a crosslink may preferably be used. As the cross-linking agent, a cross-linking agent may preferably be used which has at least two polymerizable double bonds per one molecule.

Such a cross-linking agent may include, e.g., aromatic divinyl compounds such as divinylbenzene and divinylnaphthalene; and ethylene glycol diacrylate, ethylene glycol dimethacrylate, triethylene glycol dimethacrylate, tetraethylene glycol dimethacrylate, 1,3-butylene glycol diacrylate, trimethylolpropane triacrylate, trimethylolpropane trimethacrylate, 1,4-butanediol diacrylate, neopentyl glycol diacrylate, 1,6-hexanediol diacrylate, pentaerythritol triacrylate, pentaerythritol tetraacrylate, pentaerythritol dimethacrylate, pentaerythritol tetramethacrylate, glycerol acryloxydimethacrylate, N,N-divinylaniline, divinyl ether, divinyl sulfide and divinyl sulfone.

Any of these may be used in the form of an appropriate mixture of two or more types. The cross-linking agent may previously be kept added to a polymerizable mixture, or may appropriately be added in the course of polymerization as needed.

Other monomers for the binder resin used in the magnetic-material-dispersed resin carrier may include bisphenols and epichlorohydrin, which are starting materials of epoxy resins; phenols and aldehydes, which are starting materials of phenolic resins; urea and aldehydes, which are starting materials of urea resins; and melamine and aldehydes, which are starting materials of melamine resins.

The most preferable binder resin is a phenolic resin. Its starting materials may include phenolic compounds such as phenol, m-cresol, 3,5-xylenol, p-alkylphenols, resorcin and p-tert-butyl phenol; and aldehydes such as formalin, paraformaldehyde and furfural. In particular, the combination of phenol with formalin is preferred.

Where these phenolic resins or melamine resins are used, a basic catalyst may be used as a curing catalyst. As the basic catalyst, various catalysts used in producing usual resol resins may be used. Stated specifically, it may include amines such as ammonia water, hexamethylenetetramine, diethyltriamine and polyethyleneimine.

As the metallic-compound particles used in the magnetic-material-dispersed resin carrier in the present invention may include, e.g., particles of a magnetite or ferrite having compositions represented by the formula: $MO.Fe_2O_3$ or $M.Fe_2O_4$. In the formula, M represents a trivalent, divalent or monovalent metallic ion.

The M may include Mg, Al, Si, Ca, Sc, Ti, V, Cr, Mn, Fe, Co, Ni, Cu, Zn, Sr, Y, Zr, Nb, Mo, Cd, Sn, Ba, Pb and Li.

In the above metallic-compound particles, a compound wherein M is a single compound or a compound containing a plurality of M may be used. Such metallic-compound particles may include, e.g., iron oxides such as magnetite, Zn—Fe ferrite, Mn—Zn—Fe ferrite, Ni—Zn—Fe ferrite, Mn—Mg—Fe ferrite, Ca—Mn—Fe ferrite, Ca—Mg—Fe ferrite, Li—Fe ferrite and Cu—Zn—Fe ferrite.

As the metallic-compound particles, they may preferably contain ferromagnetic metallic-compound particles such as the above magnetite or ferrite particles and metal oxide particles showing weaker magnetism than these (hereinafter simply "metal oxide particles"). As to the magnetism of the metal oxide particles, it may be weaker than that of the metallic-compound particles, and is inclusive of non-magnetism. Such metal oxide particles may include, e.g., $Al_2O_3$, $SiO_2$, CaO, $TiO_2$, $V_2O_5$, CrO, $Mn_2$, $\alpha$-$Fe_2O_3$, $\gamma$-$Fe_2O_3$, CoO, NiO, ZnO, SrO, $Y_2O_3$ and $ZrO_2$.

In the case where at least two types of metallic-compound particles are used in the form of a mixture, metallic-compound particles having similar specific gravity and particle shape may be used. This is more preferable in order to enhance the adherence to the binder resin and the strength of carrier particles. As examples of such combination, preferably usable are magnetite and hematite, magnetite and $\gamma$-$Fe_2O_3$, magnetite and $SiO_2$, magnetite and $Al_2O_3$, and magnetite and $TiO_2$. Of these, the combination of magnetite and hematite may particularly preferably be used.

In the magnetic-material-dispersed resin carrier in which two or more types of metallic-compound particles stand dispersed, the content of the metallic-compound particles showing ferromagnetism that is held in the whole metallic-compound particles to be contained may preferably be from more than 70% by weight and less than 95% by weight. If it is outside this range, it may be difficult to attain the magnetism preferable as carrier particles.

The metallic-compound particles incorporated in the magnetic-material-dispersed resin carrier used in the present invention may be those having been subjected to lipophilic treatment. This is preferable in order to make the magnetic carrier particles have a sharp particle size distribution and to prevent the metallic-compound particles from dropping off carrier particles. In particular, where carrier particles are produced by the polymerization preferably used, particles having turned insoluble in a solution are formed from a liquid medium in which a monomer and a solvent stand uniform, as polymerization reaction proceeds. In that course, the lipophilic treatment has an action of incorporating the metal oxide in the interiors of particles uniformly and in a high density and also has an action of preventing the particles themselves from agglomerating one another to sharpen their particle size distribution. Sharp particle size distribution of the carrier particles has the effect of making powder transport performance stable.

Moreover, where the lipophilicity-treated metallic-compound particles are used, it is unnecessary to use any suspension stabilizer such as calcium fluoride. This can prevent the charging performance from being inhibited by any suspension stabilizer which may otherwise remain on the carrier particle surfaces, prevent the coating resin from being non-uniform when coated, and prevent the reaction from being inhibited when the carrier particles are coated with a reactive substance such as a silicone resin and/or a coupling agent.

The lipophilic treatment may preferably be carried out using a lipophilic-treating agent which is an organic compound having at least one functional group selected from an epoxy group, an amino group and a mercapto group, or a mixture thereof. In particular, in the case where the carrier particles are produced by the polymerization preferably used, the particles may be treated with the treating agent having the group as described above, having well balanced lipophilicity, hydrophobicity and hydrophilicity, to obtain highly durable carrier particles having a stable charge-providing performance and having a high particle strength. In particular, one having an epoxy group may preferably be used.

It is preferable for the metallic-compound particles to have been treated with the lipophilic-treating agent used in an amount of from 0.1 to 10 parts by weight, and more preferably from 0.2 to 6 parts by weight, based on 100 parts by weight of the metallic-compound particles, in order to improve the lipophilicity and hydrophobicity of the metallic-compound particles.

The lipophilic-treating agent having an amino group may include, e.g., γ-aminopropyltrimethoxysilane, γ-aminopropylmethoxydiethoxysilane, γ-aminopropyltriethoxysilane, N-β-(aminoethyl)-γ-aminopropyltrimethoxysilane, N-β-(aminoethyl)-γ-aminopropylmethyldimethoxysilane, N-phenyl-γ-aminopropyltrimethoxysilane, ethylenediamine, ethylenetriamine, styrene-dimethylaminoethylacrylate or methacrylate and isoporpyl tri(N-aminoethyl)titanate.

The lipophilic-treating agent having a mercapto group may include, e.g., mercaptoethyl alcohol, mercaptopropionic acid and γ-mercaptopropyltrimethoxysilane.

The lipophilic-treating agent having an epoxy group may include γ-glycidoxypropylmethyldiethoxysilane, γ-glycidoxypropyltrimethoxysilane, β-(3,4-epoxycyclohexyl)trimethoxysilane, epichlorohydrin, glycidol and a styrene-glycidyl acrylate or methacrylate copolymer.

The magnetic carrier particles used in the present invention may preferably be used after their surfaces have been coated with a resin and/or a coupling agent. This can prevent the so called toner-spent even in long-term service; the toner-spent being such a phenomenon that the transporting powder such as the toner adheres strongly to the surfaces of the magnetic carrier particles. As a result, stable powder transport performance can be achieved over a long period of time.

The magnetic carrier used in the present invention, as described above, may preferably be used after the carrier particle surfaces have been coated with a coating resin and/or a coupling agent, from the viewpoint of improvement in anti-toner-spent properties. There are no particular limitations on the resin with which the carrier particles are coated.

Such surface-treating resin may include, e.g., polystyrene; acrylic resins such as a styrene-acrylate copolymer; and vinyl chloride, vinyl acetate, polyvinylidene fluoride resins, fluorocarbon resins, perfluorocarbon resins, solvent-soluble perfluorocarbon resins, polyvinyl alcohol, polyvinyl acetal, polyvinyl pyrrolidone, petroleum resins, cellulose, cellulose derivatives, novolak resins, low-molecular-weight polyethylene, saturated alkyl polyester resins, aromatic polyester resins, polyamide resins, polyacetal resins, polycarbonate resins, polyether sulfone resins, polysulfone resins, polyphenylene sulfide resins, polyether ketone resins, phenolic resins, modified phenolic resins, maleic resins, alkyd resins, epoxy resins, acrylic resins, unsaturated polyesters obtained by polycondensation of maleic anhydride and terephthalic acid with a polyhydric alcohol, urea resins, melamine resins, urea-melamine resins, xylene resins, toluene resins, guanamine resins, melamine-guanamine resins, acetoguanamine resins, Glyptal resin, furan resins, silicone resins, polyimide resins, polyamide-imide resins, polyether-imide resins, polyurethane resins and fluorine resins.

In particular, silicone resins and fluorine resins may preferably be used from the viewpoint of adherence to cores and prevention of toner-spent, and may each be used alone, but may preferably be used in combination with a coupling agent in order to improve film strength.

As the above coupling agent, at least part thereof may preferably be used as what is called a primer with which carrier core surfaces are treated before they are coated with the resin. This enables resin layers, in their subsequent formation, to be formed in the state of higher close adhesion involving covalent bonding.

As the transporting powder, it may be a toner containing at least a binder resin, a colorant and inorganic fine particles and having a weight-average particle diameter of from 3.0 μm to 10.0 μm. This is preferable in order to obtain appropriate fluidity and perform stable toner transport.

Toner particles preferably used in the present invention, production of the toner, and toner materials used in the production are described below. There are no particular limitations on them as long as they are materials and production processes which can be analogized with ease. Also, in the following, a non-magnetic toner is described. Needless to say, the same effect can be expected even on a magnetic toner.

The toner used in the present invention may be produced by any of a pulverization process and a polymerization process, which are processes commonly used in producing toners.

In particular, a polymerization process may preferably be used which produces the toner directly in a medium, as exemplified by suspension polymerization, interfacial polymerization and dispersion polymerization. In this polymerization process, a polymerizable monomer constituting the binder resin component, and a colorant (and also optionally a polymerization initiator, a cross-linking agent, a charge control agent and other additives) are uniformly dissolved or dispersed to form a monomer composition, and thereafter this monomer composition is dispersed in a continuous phase (e.g., an aqueous phase) containing a dispersion stabilizer, by means of a suitable stirrer to carry out polymerization reaction, obtaining a toner with a desired particle diameter. In the toner obtained by this polymerization process (hereinafter also "polymerization toner"), individual toner particles have substantially uniform spherical shapes, and hence the toner may readily be packed uniformly and appropriately in the transport pipe. As a result, it not only enables stable toner transport with less non-uniformity in replenishment at the time of long-term image reproduction, but also enables toner transport with high adaptability and high precision even when images are reproduced using charts having different image percentages.

As the binder resin used when the toner according to the present invention is produced by pulverization, it may include homopolymers of styrene or derivatives thereof, such as polystyrene and polyvinyl toluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins and polyacrylic acid resins, any of which may be used alone or in combination. In particular, styrene copolymers and polyester resins are preferred from the viewpoint of prevention of melt adhesion or prevention of blocking in the transport pipe.

In the case where the toner according to the present invention is produced by polymerization, a polymerizable monomer constituting the binder resin component may include the following: e.g., styrene monomers such as styrene, o-methylstyrene, m-methylstyrene, p-methylstyrene, p-methoxylstyrene and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminomethyl methacrylate and diethylaminomethyl methacrylate; and other acrylonitrile, methacrylonitrile and acrylamide.

Any of these monomers may be used alone or in combination. Of the above monomers, styrene or a styrene derivative may be used alone or in combination with another or other monomer(s). This is preferable from the viewpoint of prevention of melt adhesion or blocking in the transport pipe.

In the present invention, it is preferable for the toner to contain a polyester resin.

According to the studies made by the present inventors, the addition of a polyester resin makes the strength of toner particle surfaces higher. This not only is preferable from the viewpoint of prevention of melt adhesion or blocking, but also makes higher the effect of preventing inorganic fine particles on the toner particle surfaces from being embeded in toner particles as a result of long-term extensive operation (running) when additives such as inorganic fine particles are used in their external addition together with the toner particles. Thus, a change in their fluidity may be recuced inside the transport pipe, whereby their transport can be made stable.

The polyester resin may preferably have a weight-average molecular weight (Mw) of from 6,000 to 100,000. If it has an Mw of less than 6,000, the effect of preventing external additives from being embeded in toner particles may be so small as to bring about no effect of preventing charge quantity from lowering as a result of extensive operation. If on the other hand it has an Mw of more than 100,000, the condensation type resin may poorly be dispersed in the toner particles, so that the toner obtained finally may have a broad particle size distribution.

In addition, in either case of the polymerization process and the pulverization process, the binder resin may preferably have a glass transition temperature (Tg) of from 40° C. to 70° C. from the viewpoint of prevention of melt adhesion or blocking, and more preferably in the range of from 45° C. to 65° C. Any of monomers may be used alone, or may be used in the form of an appropriate mixture of monomers so mixed that the theoretical glass transition temperature (Tg) as described in a publication POLYMER HANDBOOK, 2nd Edition III, pp.139–192 (John Wiley & Sons, Inc.) ranges from 40° C. to 70° C.

The toner used in the present invention may preferably contain a release agent. As the release agent, a wax may be incorporated in a proper quantity. This enables prevention of toner melt adhesion or blocking in the transport pipe while achieving both high resolution and anti-offset properties.

The wax usable in the toner used in the present invention may include petroleum waxes and derivatives thereof such as paraffin wax, microcrystalline wax and petrolatum; montan wax and derivatives thereof; hydrocarbon waxes obtained by Fischer-Tropsch synthesis, and derivatives thereof; polyolefin waxes typified by polypropylene wax and polyethylene wax, and derivatives thereof; and naturally occurring waxes such as carnauba wax and candelilla wax, and derivatives thereof. The derivatives include oxides, block copolymers with vinyl monomers, and graft modified products. Also usable are higher aliphatic alcohols, fatty acids such as stearic acid and palmitic acid, or compounds thereof, acid amide waxes, ester waxes, ketones, hardened caster oil and derivatives thereof, vegetable waxes, and animal waxes.

In the toner used in the present invention, any of these waxes may preferably be in a content ranging from 0.5 to 25 parts by weight based on 100 parts by weight of the binder resin.

The toner used in the present invention contains a colorant in order to afford coloring power. As organic pigments or organic dyes preferably used in the present invention, they may include the following.

As organic pigments or organic dyes usable as cyan colorants, copper phthalocyanine compounds and derivatives thereof, anthraquinone compounds, basic dye lake compounds and so forth may be used. Stated specifically, they may include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66.

Organic pigments or organic dyes usable as magenta colorants include condensation azo compounds, diketopyrrolopyrrole compounds, anthraquinone compounds, quinacridone compounds, basic dye lake compounds, naphthol compounds, benzimidazolone compounds, thioindigo compounds and perylene compounds. Stated specifically, they may include C.I. Pigment Red 2, C.I. Pigment Red 3, C.I. Pigment Red 5, C.I. Pigment Red 6, C.I. Pigment Red 7, C.I. Pigment Red 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221 and C.I. Pigment Red 254.

Organic pigments or organic dyes usable as yellow colorants include compounds typified by condensation azo compounds, isoindolinone compounds, anthraquinone compounds, azo metal complexes, methine compounds and allylamide compounds. Stated specifically, they may include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191 and C.I. Pigment Yellow 194.

Any of these colorants may be used alone, in the form of a mixture, or in the state of a solid solution. The colorants used in the present invention are selected taking into account hue angle, chroma, brightness, light-fastness, transparency on OHP films and dispersibility in toner particles. In the present invention, the influence on the fluidity of toner particles is also important.

As black colorants, carbon black and colorants toned into black by the use of yellow, magenta and cyan colorants shown above are used.

The colorant may be used in an amount of from 1 to 20 parts by weight based on 100 parts by weight of the binder resin.

The toner in the present invention may also be mixed with a charge control agent for the purpose of stabilizing charge characteristics and stabilizing fluidity incidental thereto. Especially when the toner particles are produced by the pulverization process, the charge control agent also plays a role as a toner particle surface cross-linking agent. Hence, this is preferable from the viewpoint of prevention of melt adhesion or blocking in the transport pipe. As the charge control agent, any known charge control agent may be used. In particular, charge control agent having a high charging speed and also capable of maintaining a constant charge quantity stably are preferred. In the case where the toner particles are produced by the polymerization process, it is preferable to use charge control agents having a low polymerization inhibitory action and substantially free of any solubilizate in the aqueous dispersion medium. As specific compounds, they may include, as negative charge control agents, metal compounds of aromatic carboxylic acids such as salicylic acid, alkylsalicylic acids, dialkylsalicylic acids, naphthoic acid and dicarboxylic acid; metal salts or metal complexes of azo dyes or azo pigments; polymer type compounds having a sulfonic acid or carboxylic acid group in the side chain; as well as boron compounds, urea compounds, silicon compounds, and carixarene. As positive charge control agents, they may include quaternary ammonium salts, polymer type compounds having such a quaternary ammonium salt in the side chain, guanidine compounds, Nigrosine compounds and imidazole compounds.

The charge control agent may preferably be used in an amount ranging from 0.5 to 10 parts by weight based on 100 parts by weight of the binder resin.

In the case where the toner particles in the present invention are produced by the polymerization process, as the polymerization initiator used in the production of the toner particles, a polymerization initiator having a half-life of from 0.5 hour to 30 hours at the time of polymerization reaction may be used in a proportion of from 0.5 to 20 parts by weight based on 100 parts by weight of the polymerizable monomer. This enables the toner to be endowed with a desirable strength and suitable melt characteristics.

The polymerization initiator may include azo type or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide and t-butyl peroxy-2-ethylhexanoate.

In the case where the toner particles in the present invention are produced by the polymerization process, a cross-linking agent may be added preferably in an amount of from 0.001 to 15% by weight of the polymerizable monomer composition.

Here, as the cross-linking agent, compounds primarily having at least two polymerizable double bonds may be used. It may including, e.g., aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups; any of which may be used alone or in the form of a mixture.

In the case where the toner particles in the present invention are produced by the polymerization process, commonly a toner material composition, i.e., a polymerizable monomer composition prepared by appropriately adding the components necessary for the toner, such as the colorant, the release agent, a plasticizer, the charge control agent and the cross-linking agent, and other additives to the polymerizable monomer, and dissolving or dispersing these by means of a dispersion machine such as a homogenizer, a ball mill, a colloid mill or an ultrasonic dispersion machine, is suspended in an aqueous medium containing a dispersion stabilizer. Here, a high-speed stirrer or a high-speed dispersion machine may be used to allow the toner particles to have the desired particle size at a stretch. This can more readily make the resultant toner particles have a sharp particle size distribution. As the time at which the polymerization initiator is added, it may be added simultaneously when other additives are added to the polymerizable monomer, or may be added immediately before the polymerizable monomer composition is suspended in the aqueous medium to effect granulation. Also, a polymerization initiator having been dissolved in the polymerizable monomer or in a solvent may be added immediately after granulation and before the polymerization reaction is initiated.

After the granulation, agitation may be carried out using a usual agitator in such an extent that the state of particles is maintained and also the particles can be prevented from floating and settling.

In the case where the toner in the present invention is produced by the polymerization process, any known surface-active agents or organic or inorganic dispersants may be used as dispersion stabilizers. In particular, the inorganic dispersants may hardly cause any harmful ultrafine powder and they attain dispersion stability on account of their steric hindrance. Hence, even when reaction temperature is changed, they may hardly loose the stability, can be washed with ease and may hardly adversely affect toners, and hence they may preferably be used. As examples of such inorganic dispersants, they may include phosphoric acid polyvalent metal salts such as calcium phosphate, magnesium phosphate, aluminum phosphate and zinc phosphate; carbonates such as calcium carbonate and magnesium carbonate; inorganic salts such as calcium metasilicate, calcium sulfate and barium sulfate; and inorganic oxides such as calcium hydroxide, magnesium hydroxide, aluminum hydroxide, silica, bentonite and alumina.

Any of these inorganic dispersants may preferably be used alone in an amount of from 0.2 to 20 parts by weight based on 100 parts by weight of the polymerizable monomer. This may hardly cause any ultrafine particles, but is insufficient in order to form the toner of fine particles. Accordingly, it may be used in combination with a surface-active agent used in an amount of from 0.001 to 0.1 part by weight. Such a surface-active agent may include, e.g., sodium dodecylbenzenesulfate, sodium tetradecyl sulfate, sodium pentadecyl sulfate, sodium octyl sulfate, sodium oleate, sodium laurate, sodium stearate and potassium stearate.

When these inorganic dispersants are used, they may be used as they are. In order to obtain finer particles, particles of the inorganic dispersant may be formed in the dispersion medium. For example, in the case of calcium phosphate, an aqueous sodium phosphate solution and an aqueous calcium chloride solution may be mixed under high-speed agitation, whereby water-insoluble calcium phosphate can be formed and more uniform and finer dispersion can be made. Here, water-soluble sodium chloride is simultaneously formed as a by-product. However, the presence of such a water-soluble salt in the aqueous medium keeps the polymerizable monomer from dissolving in water and ultrafine toner particles is difficult to form by emulsion polymerization, and hence, is more favorable. Since its presence may be an obstacle when residual polymerizable monomers are removed at the termination of polymerization reaction, it is better to exchange the aqueous medium or desalt it with an ion-exchange resin. The inorganic dispersant can substantially completely be removed by dissolving it with an acid or an alkali after the polymerizable monomer is completed.

In the step of polymerization, the polymerization may be carried out at a polymerization temperature set at 40° C. or above, and commonly at a temperature of from 50° C. to 90° C. In order to consume residual polymerizable monomers, the reaction temperature may be raised to 90° C. to 150° C. if it is done at the termination of polymerization reaction.

The polymerization toner particles are, after the polymerization is completed, may be filtered, washed and dried by known methods, and the external additives such as inorganic fine particles may be mixed so as to be deposited on the toner particle surfaces, thus the toner can be obtained. Also, it is a preferred embodiment that the step of classification is added to the production process to remove any coarse powder and fine powder.

In the case where the toner in the present invention is produced by the pulverization process, any known method may be used. For example, components necessary for the toner particles, as exemplified by the binder resin, the release agent, the charge control agent and the colorant, and other additives are thoroughly mixed by mean of a mixer such as a Henschel mixer or a ball mill, thereafter the mixture obtained is melt-kneaded by means of a heat kneading machine such as a heat roll, a kneader or an extruder to melt the resin and so on to one another. The resultant kneaded product is cooled to solidify, followed by pulverization, thereafter classification and optionally surface treatment to obtain toner particles. Either of the classification and the surface treatment may be first in order. In the step of classification, a multi-division classifier may preferably be used in view of production efficiency.

The pulverization step may be carried out by any method making use of a known pulverizer such as a mechanical impact type or a jet type. In order to obtain a high-circularity toner preferably used so that stable powder transport performance can be achieved, it is preferable to further carry out treatment in which, e.g., heat is applied to effect pulverization or mechanical impact is auxiliarily added. Also usable are a hot-water bath method in which toner particles finely pulverized (and optionally classified) are dispersed in hot water, and a method in which the toner particles are passed through hot-air stream.

As means for applying mechanical impact force, a method is available in which toner particles are pressed against the inner wall of a casing by centrifugal force by means of a high-speed rotating blade to impart mechanical impact to the toner particles by force such as compression force or frictional force, as in apparatus such as a mechanofusion system manufactured by Hosokawa Micron Corporation or a hybridization system manufactured by Nara Machinery Co., Ltd.

The toner particles used in the present invention may still also be produced by the method as disclosed in Japanese Patent Publication No. 56-13945, in which a molten mixture is atomized in the air by means of a disk or a multiple fluid nozzle to obtain spherical toner particles; besides the suspension polymerization as the polymerization process, a dispersion polymerization method in which toner particles are directly produced using an aqueous organic solvent capable of dissolving polymerizable monomers and not capable of dissolving the resulting polymer; and an emulsion polymerization method as typified by soap-free polymerization in which toner particles are produced by direct polymerization in the presence of a water-soluble polar polymerization initiator.

In the present invention, it is preferable that the toner particles contain inorganic fine particles from the viewpoint of making the fluidity stable and that inorganic fine particles have an average primary particle diameter of from 4 nm to 80 nm.

In addition, inorganic fine particles having been subjected to hydrophobic treatment can reduce a change in fluidity of the toner particles even in an environment of high humidity, and are more preferred in order to perform stable toner transport.

As a method for such hydrophobic treatment of the inorganic fine particles, applicable ate, e.g., a method in which the inorganic fine particles are treated, as first-stage reaction, with a silane coupling agent to effect silylation reaction to cause silanol groups to disappear by chemical coupling, and a method in which the inorganic fine particles are treated with a silicone oil to form hydrophobic thin films on particle surfaces.

In the present invention, the average primary particle diameter of the inorganic fine particle is determined in the following way. A photograph of toner particles which has been taken under magnification with a scanning electron microscope is used, and is further compared with a photograph of toner particles mapped with elements the inorganic fine particles contain, by an elemental analysis means such as XMA (X-ray microanalyzer) attached to the scanning electron microscope. At least 100 primary particles of the inorganic fine particles which are present in the state they adhere to or are liberated from toner particle surfaces are observed to determine the number-average primary particle diameter.

As the inorganic fine particles used in the present invention, usable are fine powders of silica, alumina, titania and the like.

For example, as the fine silica particles, usable are what is called dry-process silica or fumed silica produced by vapor phase oxidation of silicon halides and what is called wet-process silica produced from water glass or the like, either of which may be used. The dry-process silica is preferred, as having less silanol groups on the particle surfaces and insides of the fine silica particles and leaving less production residues such as $Na_2O$ and $SO_3^{2-}$. In the dry-process silica, it is also possible to use, in its production step, other metal halide such as aluminum chloride or titanium chloride together with the silicon halide to give a composite fine powder of silica with other metal oxide. The fine silica particles include these as well.

The inorganic fine particles may preferably be added in an amount of from 0.1 to 3.0 parts by weight based on 100 parts by weight of the toner particles. If added in an amount of less than 0.1 part by weight, the effect exhibited by the addition is insufficient. If added in an amount of more than 3.0 parts by weight, the inorganic fine particles may be liberated greatly, so that the fluidity may greatly change in long-term image reproduction and no stable toner transport may be performed.

As mentioned previously, the carrier auto-refreshment developing system may preferably be used in the image forming apparatus of the present invention. In this case, it is preferable to use a replenishing developer in which the toner particles are blended in a proportion of 2 to 50 parts by weight based on 1 part by weight of the carrier particles. In long-term image reproduction, it is difficult to prevent the magnetic particles from coming off inside the transport pipe. In order to maintain stable images over a long period of time, it is preferable to use a developing system in which a replenishing developer incorporated with carrier particles in a stated quantity is used and the carrier is discharged out of the main body to its outside in a quantity corresponding to the carrier particles replenished, to perform stable toner transport over a long period of time.

EXAMPLES

The effect of the present invention is specifically described below by giving Examples. The present invention is by no means limited to these Examples.

(1) Production of magnetic particles and magnetic seal brush:

Magnetic Seal Brush

Production Example 1

| | (by weight) |
|---|---|
| Phenol | 3.6 parts |
| Formalin solution (formaldehyde: about 40%; methanol: about 10%; the balance: water) | 5.4 parts |
| Spherical fine magnetite particles (lipophilicity-treated with 1.0% by weight of γ-glycidoxypropyltrimethoxysilane; number-average particle diameter: 0.23 μm; resistivity: $4 \times 10^5$ Ω · cm) | 62.0 parts |
| Fine $\alpha$-$Fe_2O_3$ particles (lipophilicity-treated with 1.0% by weight of γ-glycidoxypropyltrimethoxysilane; number-average particle diameter: 0.57 μm; resistivity: $2.2 \times 10^9$ Ω · cm) | 26.0 parts |

A slurry of the above materials to which ammonia water as a basic catalyst and water were added was put into a flask, which was then heated to 85° C. over a period of 40 minutes with stirring and mixing, and kept at that temperature, where the reaction was carried out for 3 hours to form a phenol resin, followed by curing. Thereafter, this was cooled and water was added thereto, and then the surpernatant liquid was removed. The precipitate obtained was washed with water, and dried under reduced pressure to obtain magnetic core particles containing fine magnetite particles, having the phenol resin as a binder resin.

The carrier core particles thus obtained were subjected to core surface treatment with 0.3% by weight of N-methylaminopropyltrimethoxysilane diluted with a toluene solvent. Subsequently, the particles treated were coated with a mixture of 0.7% by weight of straight silicone resin all substitutes of which were methyl groups and 0.02% by weight of N-methylaminopropyltrimethoxysilane using toluene as a solvent. Further, the magnetic coated carrier obtained was baked at 140° C., and coarse particles formed by agglomeration were cut using a sieve of 100 meshes. Then, fine powder and coarse powder were removed by means of a multi-division air classifier to adjust particle size distribution to obtain Magnetic Particles No. 1. Magnetic Particles No. 1 thus obtained were made to adhere to the sheetlike elastic magnet (240 mT) stuck onto the transport screw in such a state as shown in FIG. 2, obtaining a magnetic brush.

Physical properties of Magnetic Particles No. 1 obtained and physical properties of the magnet are shown in Table 1 as physical properties of Magnetic Seal Brush No. 1.

Magnetic Seal Brush

Production Examples 2 and 3

Magnetic Particles No. 2 were obtained in the same manner as in the production of Magnetic Particles No. 1 in Magnetic Seal Brush Production Example 1 except that the total amount of the magnetite and hematite was not changed but the quantity ratio of the two present therein was changed to 90:10. Magnetic Particles No. 2 thus obtained were made to adhere to the 240 mT magnet stuck onto the transport screw to obtain a magnetic brush. Physical properties of Magnetic Particles No. 2 obtained and physical properties of the magnet are shown in Table 1 as physical properties of Magnetic Seal Brush No. 2.

In regard to Magnetic Seal Brush No. 3, it is one obtained using Magnetic Particles No. 2 but changing physical properties of the magnet to 500 mT.

Magnetic Seal Brush

Production Example 4

Magnetic Particles No. 3 were obtained in the same manner as in the production of Magnetic Particles No. 1 in Magnetic Seal Brush Production Example 1 except that the total amount of the magnetite and hematite was not changed but the quantity ratio of the two present therein was changed to 50:50. Magnetic Particles No. 3 thus obtained were made to adhere to the 100 mT magnet stuck onto the transport screw to obtain a magnetic brush. Physical properties of Magnetic Particles No. 3 obtained and physical properties of the magnet are shown in Table 1 as physical properties of Magnetic Seal Brush No. 4.

Magnetic Seal Brush

Production Example 5

Magnetic Particles No. 4 were obtained in the same manner as in the production of Magnetic Particles No. 2 in Magnetic Seal Brush Production Example 2 except that the spherical magnetite was changed for octahedral magnetite (number-average particle diameter: 0.25 $\mu$m; resistivity: $3\times10^5\Omega\cdot$cm). Magnetic Particles No. 4 thus obtained were made to adhere to the 240 mT magnet stuck onto the transport screw to obtain a magnetic brush. Physical properties of Magnetic Particles No. 4 obtained and physical properties of the magnet are shown in Table 1 as physical properties of Magnetic Seal Brush No. 5.

Magnetic Seal Brush

Production Example 6

Materials were so weighed as to be $Fe_2O_3$=48 mol %, CuO=28 mol % and ZnO=24 mol % in molar ratio, and were mixed by means of a ball mill. The mixture obtained was calcined at a temperature of 1,000° C., and thereafter the calcined product was pulverized by means of a ball mill. Then, 100 parts by weight of the powder obtained, 0.5 parts by weight of sodium polymethacrylate and water were put into a wet ball mill and mixed to obtain a slurry. The slurry thus obtained was granulated by means of a spray dryer. The granulated product obtained was fired at a temperature of 1,300° C., and coarse particles were removed using a sieve with a mesh opening of 250 $\mu$m, followed by classification using an air classifier (ELBOW JET LABO EJ-L3, manufactured by Nittetsu Mining Co., Ltd.) to make particle size control to obtain magnetic carrier core particles. Particle surfaces of the magnetic carrier core particles obtained were surface-treated in the same manner as in the production of Magnetic Particles No. 1 in Magnetic Seal Brush Production Example 1 to obtain Magnetic Carrier No. 5. The magnetic particles Magnetic Carrier No. 5 thus obtained was made to adhere to the 240 mT magnet stuck onto the transport screw to obtain a magnetic brush.

Physical properties of Magnetic Carrier No. 5 obtained and physical properties of the magnet are shown in Table 1 as physical properties of Magnetic Seal Brush No. 6.

Magnetic Seal Brush

Production Examples 7 and 8

Magnetic Particles Nos. 6 and 7 were obtained in the same manner as in the production of Magnetic Particles No. 1 in Magnetic Seal Brush Production Example 1 except that, in the step of removing fine powder and coarse powder by means of the multi-division air classifier, classification conditions were so changed that the particles have the intended particle size distribution. Magnetic Particles No. 6 and 7 thus obtained were each made to adhere to the 240 mT magnet stuck onto the transport screw to obtain a magnetic brush. Physical properties of Magnetic Particles Nos. 6 and 7 obtained and physical properties of the magnet are shown in Table 1 as physical properties of Magnetic Seal Brushes Nos. 7 and 8.

Magnetic Seal Brush

Production Example 9

Materials were so weighed as to be $Fe_2O_3$=56.3 mol %, MgO=23.0 mol % and SrO=20.7 mol % in molar ratio, and were mixed by means of a ball mill. The mixture obtained was calcined at a temperature of 1,000° C., and thereafter the calcined product was pulverized by means of a ball mill. This was further wet-pulverized by means of a ball mill to make it into a slurry, to which 1.0% of polyvinyl alcohol as a binder and 3% of $CaCO_3$ as a void regulator were added. The slurry thus obtained was granulated by means of a spray dryer. The granulated product obtained was fired at a temperature of 950° C., and coarse particles were removed using a sieve with a mesh opening of 250 $\mu$m, followed by classification using an air classifier (ELBOW JET LABO EJ-L3, manufactured by Nittetsu Mining Co., Ltd.) to adjust particle size, obtaining magnetic core particles. Particle surfaces of the magnetic core particles obtained were surface-treated in the same manner as in the production of Magnetic Particles No. 1 in Magnetic Seal Brush Production Example 1 to produce Magnetic Carrier No. 8. The magnetic particles Magnetic Carrier No. 8 thus obtained was made to adhere to the 240 mT magnet stuck onto the transport screw to obtain a magnetic brush.

Physical properties of Magnetic Carrier No. 8 obtained and physical properties of the magnet are shown in Table 1 as physical properties of Magnetic Seal Brush No. 9.

Magnetic Seal Brush

Production Example 10

| | (by weight) |
|---|---|
| Polyester resin composed of terephthalic acid, trimellitic anhydride and propylene-oxide-added bisphenol A derivative | 19 parts |
| Magnetite as used in Production Example 1 | 80 parts |
| Quaternary ammonium salt compound (R-51, available from Orient Chemical Industries, Ltd.) | 1 part |

The above materials were thoroughly premixed by means of a Henschel mixer, and the mixture obtained was melt-kneaded by means of a twin-screw extruder. The extruded product obtained was cooled, and thereafter crushed by means of a hammer mill into particles of about 1 to 2 mm in diameter. The crushed product was then finely pulverized by means of a finely grinding mill of an air jet system. The finely pulverized product thus obtained was further classified, and thereafter treated by dry-process coating with 0.7% by weight of styrene/methyl methacrylate copolymer resin particles of 0.02 $\mu$m in diameter by means of Hybridizer (manufactured by Nara Machinery Co., Ltd.), obtaining Magnetic Particles No. 9. Magnetic Particles No. 9 thus obtained were made to adhere to the 240 mT magnet stuck onto the transport screw to obtain a magnetic brush.

Physical properties of Magnetic Particles No. 9 obtained and physical properties of the magnet are shown in Table 1 as physical properties of Magnetic Seal Brush No. 10.

Magnetic Seal Brush

Production Example 11

Magnesium oxide was mixed in hematite so that the magnesium was in a content of 1.3% by weight. Next, 1.5% by weight of a binder (polyvinyl alcohol) and 0.5% by weight of a dispersant were added, and water was so added as to be in a slurry concentration of 50% by weight. This was wet-pulverized and mixed for 1 hour by means of an attritor manufactured by Mitsui Mining Co., Ltd. to prepare a slurry. This slurry was granulated and dried by means of a spray drier, followed by firing at 1,460° C. for 5 hours in an electric furnace and in an atmosphere of nitrogen, and coarse particles were removed using a sieve with a mesh opening of 250 μm, followed by classification using an air classifier (ELBOW JET LABO EJ-L3, manufactured by Nittetsu Mining Co., Ltd.) to adjust particle size, obtaining magnetic core particles. Particle surfaces of the magnetic core particles obtained were surface-treated in the same manner as in the production of Magnetic Particles No. 1 in Magnetic Seal Brush Production Example 1 to obtain Magnetic Particles No. 10. Magnetic Particles No. 10 thus obtained was made to adhere to a 100 mT magnet stuck onto the transport screw to obtain a magnetic brush.

Physical properties of Magnetic Particles No. 10 obtained and physical properties of the magnet are shown in Table 1 as physical properties of Magnetic Seal Brush No. 11.

Magnetic Seal Brush

Production Example 12

Materials were so weighed as to be $Li_2CO3$=43.0 mol % and $Fe_2O_3$=57.0 mol % in molar ratio, and were mixed by means of a ball mill. The mixture obtained was calcined at a temperature of 1,000° C., and thereafter the calcined product was pulverized by means of a ball mill. This was further wet-pulverized by means of a ball mill to make it into a slurry, to which 1.0% of polyvinyl alcohol as a binder and 3% of $CaCO_3$ as a void regulator. The slurry thus obtained was granulated by means of a spray dryer. The granulated product obtained was fired at a temperature of 950° C., and coarse particles were removed using a sieve with a mesh opening of 250 μm, followed by classification using an air classifier (ELBOW JET LABO EJ-L3, manufactured by Nittetsu Mining Co., Ltd.) to adjust particle size, obtaining magnetic core particles. Particle surfaces of the magnetic core particles obtained were surface-treated in the same manner as in the production of Magnetic Particles No. 1 in Magnetic Seal Brush Production Example 1 to produce Magnetic Carrier No. 11. Magnetic Carrier No. 11 thus obtained was made to adhere to the 240 mT magnet stuck onto the transport screw to obtain a magnetic brush.

Physical properties of Magnetic Carrier No. 11 obtained and physical properties of the magnet are shown in Table 1 as physical properties of Magnetic Seal Brush No. 12.

Magnetic Seal Brush

Production Example 13

Magnesium oxide was mixed in hematite so that the magnesium was in a content of 2.5% by weight. Next, 1.5% by weight of a binder (polyvinyl alcohol) and 0.5% by weight of a dispersant were added, and water was so added as to be in a slurry concentration of 50% by weight. This was wet-pulverized and mixed for 1 hour by means of an attritor manufactured by Mitsui Mining Co., Ltd. to prepare a slurry. This slurry was granulated and dried by means of a spray drier, followed by firing at 1,460° C. for 5 hours in an electric furnace and in an atmosphere of nitrogen, and coarse particles were removed using a sieve with a mesh opening of 250 μm, followed by classification using an air classifier (ELBOW JET LABO EJ-L3, manufactured by Nittetsu Mining Co., Ltd.) to adjust particle size, obtaining magnetic core particles. Particle surfaces of the magnetic core particles obtained were surface-treated in the same manner as in the production of Magnetic Particles No. 1 in Magnetic Seal Brush Production Example 1 to produce Magnetic Particles No. 12. Magnetic Particles No. 12 thus obtained was made to adhere to a 500 mT magnet stuck onto the transport screw to obtain a magnetic brush.

Physical properties of Magnetic Particles No. 12 obtained and physical properties of the magnet are shown in Table 1 as physical properties of Magnetic Seal Brush No. 13.

Magnetic Seal Brush

Production Example 14

Magnetic Particles No. 13 were obtained in the same manner as in the production of Magnetic Particles No. 9 in Magnetic Seal Brush Production Example 10 except that the content of the magnetite was reduced to 40% by weight. Magnetic Particles No. 13 thus obtained were made to adhere to a 100 mT magnet stuck onto the transport screw to obtain a magnetic brush. Physical properties of Magnetic Particles No. 13 obtained and physical properties of the magnet are shown in Table 1 as physical properties of Magnetic Seal Brush No. 14.

Magnetic Seal Brush

Production Example 15

A magnetic brush was obtained in the same manner as in Magnetic Seal Brush Production Example 1 except that Magnetic Particles No. 1 obtained were made to adhere to the ringlike magnet (650 mT) fastened onto the outer periphery of the transport pipe in such a state as shown in FIG. 5, obtaining the magnetic brush. Physical properties of Magnetic Particles No. 1 obtained and physical properties of the magnet are shown in Table 1 as physical properties of Magnetic Seal Brush No. 15.

Magnetic Seal Brush

Production Example 16

Magnetic Particles No. 14 were obtained in the same manner as in Magnetic Seal Brush Production Example 1 except that the total amount of the magnetite and hematite was not changed but the quantity ratio of the the two present therein was changed to 30:70. Magnetic Particles No. 14 thus obtained were made to adhere to the 240 mT magnet stuck onto the transport screw to obtain a magnetic brush. Physical properties of Magnetic Particles No. 14 obtained and physical properties of the magnet are shown in Table 1 as physical properties of Magnetic Seal Brush No. 16.

(2) Production of Toner:

Toner Production Example 1

In 405 parts by weight of ion-exchanged water, 250 parts by weight of an aqueous 0.1 mol/liter $Na_3PO_4$ solution was introduced, followed by heating to 60° C. Thereafter, to the resultant mixture, 40.0 parts by weight of an aqueous 1.0 mol/liter $CaCl_2$ solution was little by little added to obtain an aqueous medium containing calcium phosphate.

Meanwhile, materials formulated as shown below were uniformly dispersed and mixed using an attritor (manufactured by Mitsui Miike Engineering Corporation).

| | (by weight) |
|---|---|
| Styrene | 80 parts |
| n-Butyl acrylate | 20 parts |
| Divinylbenzene | 0.2 part |
| Saturated polyester resin (Mw: 41,000) | 4.0 parts |

-continued

| | (by weight) |
|---|---|
| Negative charge control agent (Al compound of di-tert-butylsalicylic acid) | 1 part |
| C.I. Pigment Blue 15:3 | 6.0 parts |

The monomer composition thus obtained was heated to 60° C., and 12 parts by weight of an ester wax composed primarily of behenyl behenate (maximum endothermic peak at the time of heating and measurement in DSC: 72° C.) was added thereto and mixed to dissolve it. To the mixture obtained, 3 parts by weight of a polymerization initiator 2,2'-azobis(2,4-dimethylvaleronitrile) was dissolved (under conditions of $t_{1/2}$=140 minutes and 60° C.) to prepare a polymerizable monomer composition.

The polymerizable monomer composition was introduced into the above aqueous medium, followed by stirring for 15 minutes at 60.5° C. in an atmosphere of $N_2$, using a TK-type homomixer (manufactured by Tokushu Kika Kogyo Co., Ltd.) at 10,000 rpm to carry out granulation. Thereafter, the granulated product obtained was stirred with a paddle stirring blade during which the reaction was carried out at 60.5° C. for 6 hours. Thereafter, the liquid temperature was raised to 80° C. to continue the stirring for further 4 hours. After the polymerization was completed, distillation was further carried out at 80° C. for 3 hours. Thereafter, the resultant suspension was cooled, and hydrochloric acid was added thereto to dissolve the calcium phosphate, followed by filtration and then water washing to obtain wet colored particles.

Next, the above particles were dried at 40° C. for 12 hours to obtain colored particles (toner particles).

100 parts by weight of the toner particles obtained and 1.2 parts by weight of hydrophobic fine silica particles treated with silicone oil and having a BET specific surface area of 130 $m^2/g$ and a primary particle diameter of 12 nm were mixed by means of a Henschel mixer (manufactured by Mitsui Miike Engineering Corporation) to obtain Toner (cyan toner) 1. In addition, the weight-average particle diameter of Toner 1 obtained was 6.8 $\mu$m.

Toner Production Example 2

A polymerizable monomer composition was prepared in the same manner as in Toner Production Example 1 except that, in place of 7.5 parts by weight of C.I. Pigment Blue 15:3 used, C.I. Pigment Red 122 was used in an amount of 8.0 parts by weight. This polymerizable monomer composition was introduced into the same aqueous medium as in Toner Production Example 1, followed by stirring for 15 minutes at 62° C. in an atmosphere of $N_2$, using a TK-type homomixer (manufactured by Tokushu Kika Kogyo Co., Ltd.) at 10,000 rpm to carry out granulation. Thereafter, the granulated product obtained was stirred with a paddle stirring blade during which the reaction was carried out at 62° C. for 6 hours. Thereafter, the liquid temperature was raised to 80° C. to continue the stirring for further 4 hours. After the polymerization was completed, distillation was further carried out at 80° C. for 3 hours. Thereafter, the resultant suspension was cooled, and hydrochloric acid was added thereto to dissolve the calcium phosphate, followed by filtration and then water washing to produce wet colored particles.

Next, the above particles were dried at 40° C. for 12 hours to obtain colored particles (toner particles).

100 parts by weight of the toner particles obtained and 1.2 parts by weight of hydrophobic fine silica particles treated with hexamethyldisilazane and thereafter treated with silicone oil and having a BET specific surface area of 130 $m^2/g$ and a primary particle diameter of 12 nm were mixed by means of a Henschel mixer (manufactured by Mitsui Miike Engineering Corporation), obtaining Toner (magenta toner) 2. In addition, the weight-average particle diameter of Toner 2 obtained was 6.5 $\mu$m.

Toner Production Example 3

A polymerizable monomer composition was prepared in the same manner as in Toner Production Example 1 except that, in place of 7.5 parts by weight of C.I. Pigment Blue 15:3 used, C.I. Pigment Yellow 17 was used in an amount of 8.0 parts by weight. This polymerizable monomer composition was introduced into the same aqueous medium as in Toner Production Example 1, followed by stirring for 15 minutes at 58° C. in an atmosphere of $N_2$, using a TK-type homomixer (manufactured by Tokushu Kika Kogyo Co., Ltd.) at 10,000 rpm to carry out granulation. Thereafter, the granulated product obtained was stirred with a paddle stirring blade during which the reaction was carried out at 58° C. for 6 hours. Thereafter, the liquid temperature was raised to 80° C. to continue the stirring for further 4 hours. After the polymerization was completed, distillation was further carried out at 80° C. for 3 hours. Thereafter, the resultant suspension was cooled, and hydrochloric acid was added thereto to dissolve the calcium phosphate, followed by filtration and then water washing to produce wet colored particles.

Next, the above particles were dried at 40° C. for 12 hours to obtain colored particles (toner particles).

100 parts by weight of the toner particles obtained and 1.2 parts by weight of hydrophobic fine silica particles treated with hexamethyldisilazane and having a BET specific surface area of 120 $m^2/g$ and a primary particle diameter of 20 nm were mixed by means of a Henschel mixer (manufactured by Mitsui Miike Engineering Corporation) to obtain Toner (magenta toner) 3. In addition, the weight-average particle diameter of Toner 3 obtained was 7.0 $\mu$m.

Toner Production Example 4

| | (by weight) |
|---|---|
| Styrene/n-butyl acrylate copolymer (weight ratio: 85/15; Mw: 330,000) | 80 parts |
| Saturated polyester resin (Mw: 41,000) | 4.5 parts |
| Negative charge control agent (Al compound of di-tert-butylsalicylic acid) | 3 parts |
| C.I. Pigment Blue 15:3 | 7 parts |
| Ester wax (composed chiefly of behenyl behenate; maximum endothermic peak at the time of heating and measurement in DSC: 72° C.) | 5 parts |

The above materials were mixed by means of a blender, and the mixture obtained was melt-kneaded by means of a twin-extruder heated to 110° C. The kneaded product obtained and then cooled was crushed by means of a hammer mill (manufactured by Hosokawa Micron Corporation), and then the crushed product obtained was finely pulverized using a finely grinding mill of an air jet system. Its impact plate was so adjusted that it was at an angle of 90 degrees with respect to the direction of impact. The finely pulverized product thus obtained was air-classified to obtain spherical toner particles.

Next, in 100 parts by weight of the spherical toner particles obtained, 1.2 parts by weight of hydrophobic fine silica particles treated with silicone oil and having a BET specific surface area of 130 $m^2/g$ and a primary particle diameter of 12 nm was mixed by means of a Henschel mixer (manufactured by Mitsui Miike Engineering Corporation) to obtain Toner (cyan toner) 4. In addition, the weight-average particle diameter of the toner obtained was 6.7 $\mu$m.

Toner Production Example 5

Toner 5 was obtained in the same manner as in Toner Production Example 4 except that the colored particles (toner particles) having been dried were classified using an air classifier (ELBOW JET LABO EJ-L3, manufactured by Nittetsu Mining Co., Ltd.) to adjust particle size. The weight-average particle diameter of Toner 5 obtained was 10.5 $\mu$m.

Toner Production Example 6

Toner 6 was obtained in the same manner as in Toner Production Example 4 except that the colored particles (toner particles) having been dried were classified using an air classifier (ELBOW JET LABO EJ-L3, manufactured by Nittetsu Mining Co., Ltd.) to adjust particle size. The weight-average particle diameter of Toner 6 obtained was 2.8 $\mu$m.

Toner Production Example 7

| | (by weight) |
|---|---|
| Styrene/n-butyl methacrylate/divinylbenzene copolymer (weight ratio: 70/29/1; Mw: 280,000) | 100 parts |
| Magnetic material (BET specific surface area: 7.5 $m^2/g$) | 100 parts |
| Negative charge control agent (Fe compound of monoazo dye; T-77, available from Hodogaya Chemical Co., Ltd.) | 0.5 part |
| Fischer-Tropsch wax (DSC endothermic peak temperature: 110° C.; FT-100, available from Nippon Seiro Co., Ltd.) | 3 parts |

A mixture of the above materials was melt-kneaded by means of a twin-extruder heated to 140° C. The kneaded product obtained and then cooled was crushed by means of a hammer mill, and then the crushed product obtained was finely pulverized using a jet mill. The finely pulverized product thus obtained was air-classified to obtain magnetic toner particles.

100 parts by weight of the magnetic toner particles obtained and 1.2 parts by weight of hydrophobic fine silica particles treated with silicone oil and having a BET specific surface area of 130 $m^2/g$ and a primary particle diameter of 12 nm were mixed by means of a Henschel mixer (manufactured by Mitsui Miike Engineering Corporation), obtaining Toner 7. In addition, the weight-average particle diameter of the toner obtained was 7.4 $\mu$m.

(3) Image forming apparatus:

An image forming apparatus used in Examples 1 to 20 and Comparative Examples 1 to 5 are described below.

The apparatus shown in FIG. 7 in Image Forming Apparatus Example 1 was used as an evaluation machine for making image evaluation of Examples 1 to 20 and Comparative Examples 1 to 5. This was obtained by remodeling a color copying machine CP-660, manufactured by CANON INC. As the developing means, it was remodeled to one in which a rotary type two-component developing unit is disposed facing the photosensitive member. It was further so remodeled that the carrier auto-refreshment developing system can be performed in which the developer is gradually discharged with the revolution of developing assemblies. Image formation speed (process speed) was also set to be 220 mm/sec, and a mode was provided in which the image formation speed can be slowed to a half speed (110 mm/sec). As the photosensitive member, the apparatus was so remodeled that images can be formed using an a-Si (amorphous silicon) photosensitive drum, unless noted particularly.

In the apparatus, developed images formed on the photosensitive member are first transferred to the intermediate transfer belt and then transferred from the intermediate transfer belt to the transfer material. When multi-color images are formed, developed images in multiple layer are formed on the intermediate transfer belt, and then the developed images are transferred to the transfer material in a lump.

(Two-component Developing Assembly)

An aluminum coated sleeve was used as the developing sleeve, and the space between the developing sleeve and the a-Si photosensitive drum was set to 400 $\mu$m. An AC bias used in development was applied at 1,300 Vpp as a peak-to-peak electric field intensity, and at a frequency of 2,000 Hz.

Further, in the charging step, a non-contact type corona charging system was used and an AC electric field was used as conditions for applied voltage.

Development contrast was set to be 200 V.

Example 1

Toner No. 1 and Magnetic Particles No. 1 as a carrier were weighed in amounts of 8 parts by weight and 92 parts by weight, respectively, and were blended using a V-type mixer to prepare a developer for start. The developer obtained was put into a station corresponding to the color of the toner (cyan station in the case of Example 1) in the image forming apparatus having the three stations as shown in FIG. 8. Then, in a normal-temperature normal-humidity environment (23° C., 50%RH), a 500,000-sheet image reproduction test was conducted in a full-color mode while replenishing a replenishing developer and at the image formation speed (process speed) of 220 mm/sec and a sleeve peripheral speed set to be 1.5 times (330 mm/sec) the process speed. Here, as the replenishing developer, used was a replenishing cyan developer obtained by weighing Toner No. 1 and Magnetic Particles No. 1 in amounts of 10 parts by weight and 1 part by weight, respectively, and blending them using a V-type mixer.

In addition, as the image forming apparatus, used was an apparatus in the powder transport mechanism of which the sheetlike elastic magnet (240 mT) was stuck onto the transport screw in such a state as shown in FIG. 2 and Magnetic Particles No. 1 obtained were beforehand made to adhere to the magnet of the transport screw to keep the magnetic brush formed thereon (i.e., the structure of Magnetic Seal Brush No. 1).

As a sample image used in the image reproduction test, originals of 1%, 5% and 30% in image area percentage were prepared, and were repeatedly used in the order of 5%→30%→1% to change images at intervals of 10,000 sheets for each original. Then, toner concentration (T/C ratio), image density and fog at the initial stage, on 10,000th sheet, on 20,000th sheet, on 30,000th sheet and on 500,000th sheet were evaluated according to the following evaluation methods, and good results were obtained. The evaluation results are shown in Tables 2 and 3.

Toner Concentration:

The developer on the developer carrying member (developing sleeve) was sampled in an amount of about 1 g. Thereafter, only the toner was washed away with an aqueous solution containing 1% of surface-active agent and the weight of the remaining carrier was measured, and thereafter the toner concentration was determined according to the following expression:

(Toner concentration)=(developer weight before washing−carrier weight after washing)/(developer weight before washing)

Fog:

In regard to the fog, the reflection density of white paper and the reflection density of copying machine paper at its non-image areas were measured with a reflection densitometer (Densitometer TC6MC, manufactured by Y.K. Tokyo Denshoku Gijutsu Center). A difference in reflection density between the two was evaluated on the basis of the reflection density of white paper. Evaluation was made according to the following criteria.

A: Less than 0.6%.
B: From 0.6% to less than 1.1%.
C: From 1.1% to less than 1.6%.
D: From 1.6% to less than 2.1%.
E: From 2.1% to less than 4.1%.
F: 4.1% or more.

Image Density:

As to the image density, a solid black image was copied, and its density was measured with a color reflection densitometer (Color Reflection Densitometer X-RITE 404 A, manufactured by X-Rite Co.). In the measurement, the density was measured at five spots, four corners and the middle, and was found by averaging the measured values.

Examples 2 to 19 & Comparative Examples 1 to 5

In regard to Examples 2 to 19 and Comparative Examples 1 to 5 as well, tests were conducted in the same manner as in Example 1 except that the magnetic particles (carrier), the toner and the magnetic seal brush were changed to those shown in Table 2. In Example 17, the magnetic particles were not beforehand made to adhere to the magnet in the transport pipe, and the test was carried out. In addition, as replenishing developers in Examples 2 to 16 and 18 and Comparative Examples 1 to 5, used were those obtained by blending the carrier and toner used in each Example and Comparative Example in the same ratio as that of the replenishing developer in Example 1. Also, in Examples 17 and 19, only the toner, not the replenishing developer, was replenishment. Still also, in regard to Example 19, the photosensitive member was changed from the amorphous silicon photosensitive member to an OPC (organic photoconductor) photosensitive drum to remodel the apparatus so that images can be formed on the OPC photosensitive drum. The results of evaluation are shown in Tables 2 and 3.

Example 20

In the image forming apparatus having three color stations and one black station as shown in FIG. 7, the developer as used in Example 1 was put into the cyan station, the developer as used in Example 11 into the magenta station, the developer as used in Example 12 into the yellow station, and Toner 7 into the black station. Images were formed in the same manner as in Example 1 while replenishing a replenishing developer corresponding to each color (in regard to Toner 7, a replenishing toner) As a result, good images were obtained.

TABLE 1

| | Magnetic particles | | | | | | | | | | | |
|---|---|---|---|---|---|---|---|---|---|---|---|---|
| | | Core particles | | | Coat | | | Vol. | | | | |
| Magnetic seal brush No. | Binder resin | Magnetic particles A | Non-magnetic particles B | A/B | Primer/ amt. (wt. %) | Coat material/ amt. (wt. %) | Coupling agent/ amt. (wt. %) | av. particle diam. (μm) | Saturation magnetization σs ($Am^2/kg$) | Residual magnetization σr ($Am^2/kg$) | (1) A(mT) | A × $\sigma_A$ |
| 1 | Phenol resin | Magnetite | Hematite | 70/30 | AMSL 0.3 | MSCN 0.7 | AMSL 0.02 | 36 | 55.7 | 6.0 | 240 | 12,600 |
| 2 | Phenol resin | Magnetite | Hematite | 90/10 | AMSL 0.3 | MSCN 0.7 | AMSL 0.02 | 35 | 66.4 | 6.5 | 240 | 15,600 |
| 3 | Phenol resin | Magnetite | Hematite | 90/10 | AMSL 0.3 | MSCN 0.7 | AMSL 0.02 | 35 | 66.4 | 6.5 | 500 | 32,500 |
| 4 | Phenol resin | Magnetite | Hematite | 50/50 | AMSL 0.3 | MSCN 0.7 | AMSL 0.02 | 34 | 39.1 | 4.1 | 100 | 3,300 |
| 5 | Phenol resin | Magnetite | Hematite | 90/10 | AMSL 0.3 | MSCN 0.7 | AMSL 0.02 | 38 | 68.1 | 10.5 | 240 | 15,600 |
| 6 | — | Cu—Zn ferrite | — | — | AMSL 0.3 | MSCN 0.7 | AMSL 0.02 | 48 | 65.3 | 0.0 | 240 | 15,600 |
| 7 | Phenol resin | Magnetite | Hematite | 70/30 | AMSL 0.3 | MSCN 0.3 | AMSL 0.02 | 63 | 53.9 | 4.9 | 240 | 12,000 |
| 8 | Phenol resin | Magnetite | Hematite | 70/30 | AMSL 0.3 | MSCN 0.3 | AMSL 0.02 | 24 | 54.2 | 5.1 | 240 | 7,200 |
| 9 | — | Mn—Mg ferrite | — | — | AMSL 0.3 | MSCN 0.7 | AMSL 0.02 | 41 | 64.1 | 2.1 | 240 | 15,600 |
| 10 | Poly-ester | Magnetite | — | — | — 0.7 | St-MMA | — | 50 | 67.8 | 4.7 | 240 | 15,600 |
| 11 | — | Mg ferrite | — | — | AMSL 0.3 | MSCN 0.3 | AMSL 0.02 | 40 | 85.0 | 1.2 | 100 | 8,200 |
| 12 | — | Li ferrite | — | — | AMSL 0.3 | MSCN 0.3 | AMSL 0.02 | 58 | 25.0 | 1.0 | 240 | 4,800 |
| 13 | — | Mg | — | — | AMSL | MSCN | AMSL | 50 | 80.0 | 1.0 | 500 | 37,000 |

TABLE 1-continued

| Magnetic seal brush No. | Binder resin | Magnetic particles: Core particles: Magnetic particles A | Non-magnetic particles B | A/B | Coat: Primer/amt. (wt. %) | Coat material/amt. (wt. %) | Coupling agent/amt. (wt. %) | Vol. av. particle diam. (μm) | Saturation magnetization σs (Am²/kg) | Residual magnetization σr (Am²/kg) | (1) A(mT) | A × $\sigma_A$ |
|---|---|---|---|---|---|---|---|---|---|---|---|---|
| | | ferrite | | | 0.3 | 0.3 | 0.02 | | | | | |
| 14 | Polyester | Magnetite | — | — | — | St-MMA 0.7 | — | 53 | 30.0 | 1.0 | 100 | 2,500 |
| 15 | Phenol resin | Magnetite | Hematite | 70/30 | AMSL 0.3 | MSCN 0.7 | AMSL 0.02 | 36 | 55.7 | 6.0 | 650 | 15,400 |
| 16 | Phenol resin | Magnetite | Hematite | 30/70 | AMSL 0.3 | MSCN 0.7 | AMSL 0.02 | 34 | 27.0 | 2.3 | 240 | 6,000 |

(1) Residual magnetic flux density of magnetic-filed generation means AMSL: Aminosilane; MSCN: Methylsilicone; St-MMA: styrene-methylmethacrylate copolymer

TABLE 2

| | Magnetic particles No. | Toner No. | Magnetic seal brush No. | Start developer concentration (carrier/toner) | Replenishing developer concentration (carrier/toner) | Initial stage: Toner concentration | Initial stage: Fog | Initial stage: Image density | 10,000th sheet: Toner concentration | 10,000th sheet: Fog | 10,000th sheet: Image density |
|---|---|---|---|---|---|---|---|---|---|---|---|
| Example: | | | | | | | | | | | |
| 1 | 1 | 1 | 1 | 92/8 | 1/10 | 8.0 | A | 1.50 | 8.0 | A | 1.50 |
| 2 | 2 | 1 | 2 | 92/8 | 1/10 | 8.0 | A | 1.50 | 8.0 | A | 1.50 |
| 3 | 2 | 1 | 3 | 92/8 | 1/10 | 8.0 | A | 1.50 | 7.3 | B | 1.37 |
| 4 | 3 | 1 | 4 | 92/8 | 1/10 | 8.0 | A | 1.50 | 8.2 | C | 1.50 |
| 5 | 4 | 1 | 5 | 92/8 | 1/10 | 8.0 | A | 1.50 | 7.9 | B | 1.49 |
| 6 | 5 | 1 | 6 | 92/8 | 1/10 | 8.0 | A | 1.50 | 8.2 | B | 1.50 |
| 7 | 6 | 1 | 7 | 92/8 | 1/10 | 8.0 | A | 1.50 | 8.6 | B | 1.52 |
| 8 | 7 | 1 | 8 | 92/8 | 1/10 | 8.0 | A | 1.50 | 7.7 | A | 1.40 |
| 9 | 8 | 1 | 9 | 92/8 | 1/10 | 8.0 | A | 1.50 | 8.2 | A | 1.50 |
| 10 | 9 | 1 | 10 | 92/8 | 1/10 | 8.0 | A | 1.50 | 8.1 | A | 1.50 |
| 11 | 1 | 2 | 1 | 92/8 | 1/10 | 8.0 | A | 1.50 | 8.0 | A | 1.50 |
| 12 | 1 | 3 | 1 | 92/8 | 1/10 | 8.0 | A | 1.50 | 8.0 | A | 1.50 |
| 13 | 1 | 4 | 1 | 92/8 | 1/10 | 8.0 | A | 1.50 | 7.9 | A | 1.49 |
| 14 | 1 | 5 | 1 | 92/8 | 1/10 | 8.0 | A | 1.50 | 7.4 | A | 1.51 |
| 15 | 1 | 6 | 1 | 92/8 | 1/10 | 8.0 | A | 1.50 | 9.5 | B | 1.49 |
| 16 | 1 | 1 | 1 | 92/8 | 1/10 | 8.0 | A | 1.50 | 8.6 | A | 1.52 |
| 17 | 1 | 1 | 1 | 92/8 | 0/10 | 8.0 | A | 1.50 | 8.9 | A | 1.54 |
| Comparative Example: | | | | | | | | | | | |
| 1 | 10 | 1 | 11 | 92/8 | 1/10 | 8.0 | A | 1.50 | 6.9 | E | 1.34 |
| 2 | 11 | 1 | 12 | 92/8 | 1/10 | 8.0 | A | 1.50 | 9.4 | E | 1.66 |
| 3 | 12 | 1 | 13 | 92/8 | 1/10 | 8.0 | A | 1.50 | 6.4 | E | 1.29 |
| 4 | 13 | 1 | 14 | 92/8 | 1/10 | 8.0 | B | 1.50 | 9.8 | F | 1.70 |
| 5 | 14 | 1 | 16 | 92/8 | 1/10 | 8.0 | A | 1.50 | 8.8 | D | 1.36 |
| Example: | | | | | | | | | | | |
| 18 | 1 | 1 | 15 | 92/8 | 1/10 | 8.0 | A | 1.50 | 8.0 | A | 1.50 |
| 19 | 1 | 1 | 1 | 92/8 | 0/10 | 8.0 | A | 1.50 | 8.9 | A | 1.52 |

TABLE 3

| | 20,000th sheet: Toner concentration | Fog | Image density | 30,000th sheet: Toner concentration | Fog | Image density | 500,000th sheet: Toner concentration | Fog | Image density | Remarks |
|---|---|---|---|---|---|---|---|---|---|---|
| Example: | | | | | | | | | | |
| 1 | 7.1 | A | 1.50 | 8.8 | A | 1.50 | 7.6 | A | 1.49 | |
| 2 | 7.0 | A | 1.50 | 9.0 | A | 1.50 | 7.5 | A | 1.48 | |
| 3 | 5.2 | C | 1.42 | 8.0 | C | 1.22 | 6.6 | C | 1.35 | |
| 4 | 8.0 | C | 1.65 | 11.3 | C | 1.45 | 6.9 | C | 1.35 | |

TABLE 3-continued

| | 20,000th sheet | | | 30,000th sheet | | | 500,000th sheet | | | |
|---|---|---|---|---|---|---|---|---|---|---|
| | Toner concentration | Fog | Image density | Toner concentration | Fog | Image density | Toner concentration | Fog | Image density | Remarks |
| 5 | 7.5 | B | 1.56 | 9.4 | B | 1.43 | 7.3 | C | 1.41 | |
| 6 | 7.6 | B | 1.57 | 9.5 | B | 1.55 | 7.3 | C | 1.42 | |
| 7 | 7.8 | C | 1.59 | 10.7 | C | 1.56 | 7.2 | C | 1.38 | |
| 8 | 7.8 | B | 1.61 | 9.7 | C | 1.41 | 7.4 | C | 1.38 | |
| 9 | 7.4 | B | 1.52 | 9.3 | B | 1.53 | 7.2 | B | 1.46 | |
| 10 | 7.1 | A | 1.50 | 9.1 | B | 1.51 | 7.4 | B | 1.48 | |
| 11 | 6.9 | A | 1.50 | 8.7 | A | 1.50 | 7.5 | A | 1.49 | |
| 12 | 7.2 | A | 1.50 | 9.2 | A | 1.50 | 7.7 | A | 1.49 | |
| 13 | 7.0 | A | 1.49 | 8.4 | A | 1.48 | 7.3 | A | 1.47 | |
| 14 | 6.0 | B | 1.56 | 9.8 | A | 1.52 | 7.4 | B | 1.44 | |
| 15 | 5.4 | C | 1.55 | 11.7 | B | 1.44 | 9.7 | C | 1.40 | |
| Example: | | | | | | | | | | |
| 16 | 7.4 | A | 1.53 | 8.8 | A | 1.50 | 7.6 | A | 1.49 | No adhesion of magnetic particles at start. |
| 17 | 8.0 | B | 1.55 | 9.6 | B | 1.52 | *1 | | | Only toner is used as replenishing developer. |
| Comparative Example: | | | | | | | | | | |
| 1 | 6.0 | E | 1.67 | 5.0 | F | 1.19 | Finished by examining 100,000 sheets. | | | |
| 2 | 10.7 | F | 1.77 | 13.6 | F | 1.80 | Finished by examining 100,000 sheets. | | | |
| 3 | 5.1 | F | 1.72 | 4.8 | F | 1.10 | Finished by examining 100,000 sheets. | | | |
| 4 | 11.5 | F | 1.82 | 15.1 | F | 1.82 | Finished by examining 100,000 sheets. | | | |
| 5 | 7.9 | D | 1.41 | 12.2 | E | 1.29 | Finished by examining 150,000 sheets. | | | |
| Example: | | | | | | | | | | |
| 18 | 7.1 | A | 1.50 | 8.9 | A | 1.50 | 7.6 | A | 1.49 | ringlike magnet is used. |
| 19 | 7.9 | B | 1.53 | 9.5 | B | 1.50 | *1 | | | OPC drum is used. Only toner as transporting powder. |

*1: Finished with 50,000 sheets because of no carrier auto-replenishment.

What is claimed is:

1. An image forming apparatus comprising:

a powder transport mechanism including a powder container and a powder transport means, which is rotatable relative to said powder container, wherein said powder transport means has a rotation center substantially on an axis of said powder container, a space between an inner wall surface of said powder container and said powder transport means is sealed with magnetic particles held by a magnetic-field generation means, and said magnetic particles have a saturation magnetization σs in a range of 30.0 to 80.0 $Am^2/kg$ and a value of $A \times \sigma_A$ in a range of 3,000 to 35,000, where a residual magnetic flux density of said magnetic-filed generation means is represented by A mT and a magnetization intensity of the magnetic particles in a magnetic field with the residual magnetic flux density A mT is represented by $\sigma_A$ $Am^2/kg$, provided that A is within a range of 50 to 1,000 mT.

2. The image forming apparatus according to claim 1, wherein said powder container includes a transport pipe and said powder transport means including a transport screw.

3. The image forming apparatus according to claim 1, wherein the value of $A \times \sigma_A$ is in the range of 3,500 to 30,000, provided that A is within the range of 50 to 1,000 mT.

4. The image forming apparatus according to claim 1, wherein said magnetic particles have a residual magnetization σr in a range of 0.1 to 10.0 $Am^2/kg$ in 5,000/4 p kA/m.

5. The image forming apparatus according to claim 1, wherein said magnetic particles have a volume-average particle diameter of from 25 μm to 60 μm.

6. The image forming apparatus according to claim 1, wherein said magnetic particles comprises a binder resin and a magnetic powder.

7. The image forming apparatus according to claim 6, wherein said binder resin comprises a phenolic resin.

8. The image forming apparatus according to claim 1, wherein the powder to be transported by said powder transport means is a toner including toner particles containing at least a binder resin and a colorant, and inorganic fine particles, and the toner has a weight-average particle diameter in a range of 3.0 μm to 10.0 μm.

9. The image forming apparatus according to claim 1, wherein said magnetic particles have been previously held by the magnetic-filed generation means in said powder transport mechanism.

10. The image forming apparatus according to claim 1, wherein said magnetic particles are fed by means of a developing unit comprising a plurality of developing assemblies, which are moved while rotating.

11. The image forming apparatus according to claim 1, wherein the powder to be transported by said powder transport means is a blend of i) a toner including toner particles containing at least a binder resin and a colorant, and inorganic fine particles and ii) a magnetic carrier having a saturation magnetization σs in a range of 30.0 to 80.0 $Am^2/kg$ and a value of $A \times \sigma_A$ in a range of 3,000 to 35,000, where the residual magnetic flux density of said magnetic-filed generation means is represented by A mT and the magnetization intensity of the magnetic particles in a magnetic field with the residual magnetic flux density of A mT is represented by $\sigma_A$ $Am^2/kg$.

* * * * *